US006245496B1

(12) United States Patent
Yokozawa

(10) Patent No.: US 6,245,496 B1
(45) Date of Patent: Jun. 12, 2001

(54) SILVER HALIDE COLOR PHOTOGRAPHIC LIGHT-SENSITIVE MATERIAL AND METHOD OF FORMING A COLOR IMAGE

(75) Inventor: Akito Yokozawa, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/512,670

(22) Filed: Feb. 24, 2000

(30) Foreign Application Priority Data

Feb. 26, 1999 (JP) ..... 11-051071

(51) Int. Cl.[7] ..... G03C 1/09

(52) U.S. Cl. ..... 430/543; 430/363; 430/383; 430/963

(58) Field of Search ..... 430/543, 963

(56) References Cited

U.S. PATENT DOCUMENTS 4,840,878 6/1989 Hirose et al. ..... 430/380
5,206,120 * 4/1993 Hayashi ..... 430/376
5,672,468 * 9/1997 Okazaki ..... 430/522

* cited by examiner

*Primary Examiner*—Hoa Van Le
(74) *Attorney, Agent, or Firm*—Birch, Stewart, Kolasch & Birch, LLP.

(57) ABSTRACT

A color light sensitive material can be rapidly processed and is suitable for both surface exposure and high intensity scanning exposure. The exposed light sensitive material has excellent sharpness and residual color. The silver halide color photographic light sensitive material has on a support at least one silver halide emulsion layer containing a yellow dye forming coupler, at least one silver halide emulsion layer containing a magenta dye forming coupler, and at least one silver halide emulsion layer containing a cyan dye forming coupler. The characteristic colors of yellow, magenta and cyan are obtained using exposures according to a logarithmic relationship.

12 Claims, No Drawings

SILVER HALIDE COLOR PHOTOGRAPHIC LIGHT-SENSITIVE MATERIAL AND METHOD OF FORMING A COLOR IMAGE

FIELD OF THE INVENTION

The present invention relates to a color light-sensitive material that has rapid-processability and suitability for both surface exposure and high-intensity-scanning exposure, and that is excellent in both remaining (residual) color and sharpness. Further, the present invention relates to a method of forming an image using the light-sensitive material.

BACKGROUND OF THE INVENTION

Color photographs, which are now widespread, have become more and more rapidly and easily obtained owing to progress of both light-sensitive materials themselves and processing techniques. Particularly in the field of color prints, production that complies with a variety of purposes has been practiced owing to the development of a centralization processing system based on a production point, called a color lab, which has high-speed printers and large-size processors for mass production (large-volume processing), and a dispersion processing system using small-size printer processors, which are called mini-lab and are set up at the front of shops. In recent years, light-sensitive materials using a high silver chloride emulsion, and processing methods therefor, have been put to practical use, so that color prints have become more rapidly and more easily obtained.

Further, recently color prints have been provided using digital image data formed by reading a negative or positive image by means of a scanner. By changing image information into a digital form, such corrections as gradation retouching, cover printing, and introduction of a letter or character at the time of production of postcards, can be done on the monitor of a computer, without a lith film. Consequently, this contributes to improvement in productivity and quality of the color print. Further, it is also possible to receive image data via the Internet and prepare a color print using the image data. Such a system is expected to be more widespread in the future. In order to obtain a color print using digital image data, a scanning exposure has been carried out by one pixel using a light source, such as a cathode ray (CRT) and a laser, in place of a conventional surface exposure through a negative film.

As to rapid processing, U.S. Pat. No. 4,840,878 discloses a method of processing a color photographic light-sensitive material containing a silver halide emulsion having a high silver chloride content, with a color developer substantially free from sulfurous acid ions and benzyl alcohol.

SUMMARY OF THE INVENTION

Rapid-processability (faster processing speed) can be improved by increasing the reaction speed of silver halide during color development according to the above-described method. However, it was found that, when the processing time was further reduced, remaining color became a serious problem, which should be solved. If the processing time is simply shortened, remaining color occurs particularly due to rinse inadequacy of an anti-irradiation dye, which results in stain on the white background. On the other hand, if a coating amount of the anti-irradiation dye in a light-sensitive material has been preliminarily reduced, the remaining color is also lowered. However, sharpness is deteriorated, thereby causing a problem in the quality of a print.

Further, when a color print is prepared by the above-mentioned scanning exposure, if a photosensitive material is exposed to a light exhibiting the same intensity of illumination as in a surface exposure, the same exposure time as in the surface exposure is required for every pixel. Accordingly, exposure is carried out using a very strong (high illumination intensity) light, to shorten the exposure time per pixel. This is called a "high-illumination-intensity scanning exposure." Such a scanning exposure further deteriorates sharpness in comparison with conventional surface exposure. Consequently, the high intensity scanning exposure prevents the improvement of properties of a color print obtained using digital image data. In a high silver chloride light-sensitive material that is used to produce a color print by carrying out an ordinary surface exposure, soft gradation enhancement occurs by a high-illumination-intensity, short-time scanning exposure. This is a cause of deteriorated sharpness. The soft gradation enhancement due to the high-intensity, short-time scanning exposure can be improved by containing a metal ion belonging to group VIII of the periodic table into photosensitive silver halide grains, as described in JP-A-7-104448 ("JP-A" means unexamined published Japanese patent application), column 74, lines 19 to 44, and JP-A-7-77775, column 46, line 30, to column 47, line 5. However, the use of only such a technique is insufficient to improve sharpness obtained by a scanning exposure up to the level achieved by a surface exposure. It is possible to produce a higher contrast photosensitive material that exhibits satisfactory sharpness by a high-illumination-intensity scanning exposure, in disregard of the gradation that is necessary for a lower-intensity surface exposure. However, this technique necessitates respective two photosensitive materials for use with each of surface exposure and scanning exposure. Consequently, this technical policy unpreferably increases stored photosensitive materials in a color lab. Further, when digital image data are exposed by a scanning exposure, the exposure amount is not a continuous value but an intermittent (discontinuous) one. Therefore, if the gradation of the photosensitive material is too hard, an intermittent change in density can be seen with the naked eye, undesirably. Such problems are involved with scanning exposure.

Accordingly, an object of the present invention is to provide a color light-sensitive material that has not only an excellent rapid processability and suitability for both surface exposure and high-illumination-intensity scanning exposure, but also reduced remaining color and excellent sharpness.

Another object of the present invention is to provide a method of forming an image by using the above-described light-sensitive material, which enables rapid formation of a good-quality image by either surface exposure or high-illumination-intensity scanning exposure.

Other and further objects, features, and advantages of the invention will appear more fully from the following description.

DETAILED DESCRIPTION OF THE INVENTION

As a result of intensive investigation, the present inventor has found that the above-described objects of the present invention are achieved by the following means:

(1) A silver halide color photographic light-sensitive material having, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, wherein at least one layer of the silver halide emulsion layers contains light-sensitive silver halide grains which have a silver chloride content of 95 mol % or more and which contain a metal ion belonging to group VIII of the periodic table, wherein the total amount of a hydrophilic binder in photographic constitutional layers of the light-sensitive material is 6.7 $g/m^2$ or less, wherein the maximum optical density in the visible region of 400 nm to 800 nm of the light-sensitive material is from 0.2 to 0.7, and wherein the following relations are established with each of the characteristic curves of yellow, magenta, and cyan images, which images are obtained by subjecting the light-sensitive material to exposure and then a color processing (which includes color-development and subsequent steps, such as bleach-fixing, washing and/or stabilizing):

$$0.7 \leqq \log (E_1/E_2) \leqq 1.3, \text{ and}$$

$$0.7 \leqq \log (E'_1/E'_2) \leqq 1.3, \text{ and}$$

$$-0.2 \leqq \log (E'_1/E'_2) - \log (E_1/E_2) \leqq 0.2$$

in which $E_1$ represents an exposure amount necessary to obtain a color density of Dmin+1.8 in each of the characteristic curves of yellow-, magenta-, and cyan-colored images obtained by a 1-second exposure followed by a color processing;

$E_2$ represents an exposure amount necessary to obtain a color density of Dmin+0.02 in each of the characteristic curves of yellow-, magenta-, and cyan-colored images obtained by a 1-second exposure followed by a color processing;

$E'_1$ represents an exposure amount necessary to obtain a color density of Dmin+1.8 in each of the characteristic curves of yellow-, magenta-, and cyan-colored images obtained by a $10^{-4}$-second exposure followed by a color processing;

$E'_2$ represents an exposure amount necessary to obtain a color density of Dmin+0.02 in each of the characteristic curves of yellow-, magenta-, and cyan-colored images obtained by a $10^{-4}$-second exposure followed by a color processing; and Dmin represents a density obtained by subjecting an unexposed light-sensitive material to a color processing.

(2) The silver halide color photographic light-sensitive material as described in item (1), wherein the total amount of a hydrophilic binder of the photographic constitutional layers is 6.0 $g/m^2$ or less, and the film thickness of the photographic constitutional layers is 8.0 $\mu$m or less.

(3) The silver halide photographic light-sensitive material as described in item (1) or (2), wherein the silver halide emulsion layer containing a yellow dye-forming coupler is positioned more remote from the support in comparison with the silver halide emulsion layer containing a magenta dye-forming coupler or the silver halide emulsion layer containing a cyan dye-forming coupler.

(4) The silver halide color photographic light-sensitive material as described in item (1), (2), or (3), further comprising an anti-irradiation dye represented by the following formula (I):

Formula (I)

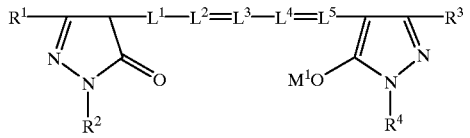

wherein $R^1$ and $R^3$ each represent an electron-withdrawing group having a Hammett's substituent constant op value of 0.3 or more; $R^2$ and $R^4$ each represent an alkyl group or an aryl group; $L^1$, $L^2$, $L^3$, $L^4$, and $L^5$ each represent a methine group; $M^1$ represents a hydrogen atom, or an atomic group or metal ion that forms a monovalent cation, with the proviso that at least one of $L^1$ to $L^5$ has a substituent.

(5) The silver halide color light-sensitive material as described in item (1), (2), (3), or (4), wherein at least a half of silver halide grains, in terms of the silver amount, comprises tabular high-silver-chloride silver halide grains having an average aspect ratio of 4 or more and a silver chloride content of 95 mol % or more, in the silver halide emulsion of the light-sensitive layer containing a yellow dye-forming coupler.

(6) The silver halide color photographic light-sensitive material as stated in any one of the items (1) to (5), wherein the light-sensitive silver halide grains contain at least one gold sensitizer.

(7) The silver halide color photographic light-sensitive material as stated in any one of the items (1) to (6), wherein a weight ratio of amounts of oil-soluble materials to that of hydrophilic binder in the photographic constitutional layers other than protective layers is 0.05 to 1.50.

(8) The silver halide color photographic light-sensitive material as stated in any one of the items (1) to (7), wherein the metal ion of group VIII of the periodic table is an ion of a metal selected from the group consisting of iron, cobalt, nickel, ruthenium, rhodium, iridium, and platinum.

(9) A method of forming a color image, which comprises processing the silver halide color photographic light-sensitive material as stated in any one of the items (1) to (8), at a color developing time of 20 seconds or less.

(10) A method of forming a color image, which comprises subjecting the silver halide color photographic light-sensitive material as stated in any one of the items (1) to (8), to a scanning exposure at an exposure time of $10^{-4}$ seconds or less, and subjecting the resultant light-sensitive material to development processing.

Herein, in the specification, the "high-illumination intensity" in the "high-illumination-intensity scanning exposure" means that an illumination intensity necessary to give a prescribed color density by scanning exposure is 100-fold or more an illumination intensity necessary to give the same color density by surface exposure.

The present invention is explained below in more detail.

In the silver halide color photographic light-sensitive material according to the present invention, gelatin is used as a hydrophilic binder. As occasion demands, gelatin may be used in combination with hydrophilic colloids, for example, other gelatin, gelatin derivatives, graft polymers of gelatin and another polymer, proteins other than gelatin, sugar derivatives, cellulose derivatives, and synthetic hydrophilic macromolecular materials such as homo- or co-polymers.

Gelatin which is used in a silver halide color photographic light-sensitive material according to the present invention, may be a lime-processed gelatin, or an acid-processed gelatin. Alternatively, a gelatin made from any of raw materials such as a cattle (beef) bone, a calfskin, and a pig skin, also may be used. Preferred is a lime-processed gelatin made from a cattle bone, or a pig skin as a raw material.

In the present invention, the total amount of a hydrophilic binder contained in light-sensitive silver halide emulsion layers and light-insensitive hydrophilic colloid layers consisting of from the silver halide emulsion layer nearest to a support to the hydrophilic colloid layer further-most from the support, all of which layers lie at the silver halide emulsion layer-coating side on the support, is preferably 6.7 $g/m^2$ or less, more preferably 6.0 $g/m^2$ or less, and most preferably from 5.5 $g/m^2$ to 4.0 $g/m^2$, from the viewpoints of rapid processability and sharpness. The smaller an amount of a hydrophilic binder is, the more effective it is to advances in (to make more rapid) processing speed of color development and washing steps, and sharpness at the time of a scanning exposure, in particular.

In the present invention, the term "the silver halide emulsion layer located in the farther-most position from the support" means the layer located farther-most from a support among layers each containing a silver halide emulsion capable of substantially contributing dye formation occurring due to a reaction between a coupler and a developed silver halide emulsion incorporated in the same layer. Accordingly, a layer containing a fine grain emulsion having substantially no sensitivity, or a colloidal silver, and free from a coupler, does not fall under the definition of the above-mentioned silver halide emulsion layer.

In the present invention, the ratio of [amount of hydrophilic binder/thickness of silver halide emulsion] in the yellow coupler-containing silver halide emulsion layer further-most from a support, is preferably 1.50 or more. The ratio in the present invention is hereinafter referred to as the [B/AgX].

In this specification, the term "an amount of a hydrophilic binder" means an amount ($g/m^2$) of a hydrophilic binder per $m^2$ of the silver halide emulsion layer. The amount of a hydrophilic binder divided by its specific gravity means a thickness. Accordingly, the amount of a hydrophilic binder referred to in the present invention is in proportion to the thickness.

On the other hand, the term "thickness of silver halide emulsion" means a thickness ($\mu$m) at which silver halide emulsion grains in the silver halide emulsion layer occupy in the direction perpendicular to a support. Assuming that a silver halide emulsion layer is ideally coated in the present invention, a side length ($\mu$m) of the cube (when the silver halide grains are cubic), and a thickness ($\mu$m) in the direction perpendicular to main planes (when the silver halide grains are tabular), are defined to as a thickness of silver halide emulsion, respectively. Further, when two or more kinds of silver halide emulsion grains having a different grain size from each other is used in mixture, a weight average value of individual grains is defined as the thickness of a silver halide emulsion.

As is apparent from the above-mentioned definition, the ratio of [B/AgX] in the present invention means that the bigger the value is, the relatively smaller the thickness of an emulsion in the emulsion layer is. From the viewpoints of restraint of pressure-induced fog streaks and reduction in processing color contamination (color mix), the ratio of [B/AgX] in the present invention is preferably 1.50 or more, but 15 or less, more preferably 1.70 or more, further more preferably 1.90 or more, but 12 or less, and particularly preferably 6.0 or more, but 10 or less.

The amount of a hydrophilic binder in the silver halide emulsion layer containing a yellow coupler further-most from a support according to the present invention, is preferably 1.35 $g/m^2$ or less, more preferably 1.25 $g/m^2$ or less, and most preferably in the range of 1.20 $g/m^2$ or less but 0.60 $g/m^2$ or more. Further, with respect to the thickness of a silver halide emulsion, when cubic grains are used, the thickness is preferably 0.80 $\mu$m or less, more preferably 0.75 $\mu$m or less, and most preferably 0.70 $\mu$m or less but 0.30 $\mu$m or more. When tabular grains are used, the thickness is preferably 0.30 $\mu$m or less, more preferably 0.20 $\mu$m or less, and most preferably 0.15 $\mu$m or less but 0.05 $\mu$m or more. The aspect ratio of the tabular grains is preferably in the range of 4 to 15, and more preferably in the range of 5 to 13. Further, two or more kinds of silver halide emulsions having a different grains size and/or grain shape from each other are preferably used in mixture, in order to control photographic speed, gradation and other photographic properties.

As a silver halide emulsion which can be used in the present invention, it is necessary from the viewpoint of advances in color development speed to use a silver halide, for example, silver chloride, silver chlorobromide, silver iodochloride, or silver chloroiodobromide, each of which has a silver chloride content of 95 mol % or more, in at least one layer of the silver halide emulsion layers. Of these silver halides, more preferred are cubic silver halide grains each of which has a silver chloride content of 98 mol % or more, and has a silver bromide-localized phase on the surface of the silver chloride grain. Further, the use of tabular grains whose main planes have a (111) face or a (100) face, is preferred in the present invention, because they make the ratio of [B/AgX] larger, allowing color development to be rapidly carried out, processing color mix to be reduced, and sharpness at the time of scanning exposure to be improved. The tabular high-silver-chloride emulsion grains whose main planes have a (111) face, or a (100) face, can be prepared by the methods disclosed in, for example, JP-A-6-138619, U.S. Pat. Nos. 4,399,215, 5,061,617, 5,320,938, 5,264,337, 5,292,632, 5,314,798, and 5,413,904, and WO 94/22051.

The term "oil-soluble materials in the photographic constituent layers" referred to in the present invention, means lipophilic ingredients remaining in the processed light-sensitive material. Specific examples include a coupler, a color-mix inhibitor, an ultra violet absorber, lipophilic additives, a lipophilic polymer latex, a matte agent, and a sliding (slipping) agent. In other words, such ingredients are those usually added into the photographic constituent layers as a lipophilic fine particle. Accordingly, a water-soluble dyestuff, a hardening agent, water-soluble additives, a silver halide emulsion, and the like do not fall under the definition of the oil-soluble material. Further, a surface active agent is usually used, when such lipophilic fine particles are prepared. However, the surface active agent is not dealt with the oil-soluble material in the present invention.

The total amount of the oil-soluble material in the present invention is preferably 4.5 $g/m^2$ or less, more preferably 4.0 $g/m^2$ or less, and most preferably in the range of 3.8 $g/m^2$ to 3.0 $g/m^2$.

The ratio of the amount of oil-soluble materials to the amount of a hydrophilic binder in the photographic constituent layers may be optionally determined in the present invention. The ratio in weight for the photographic constituent layers except for a protective layer is preferably in the range of 0.05 to 1.50, more preferably in the range of 0.10 to 1.40, and most preferably in the range of 0.20 to 1.30. Optimization of the ratio for each of the layers allows a film strength, a scratch resistance, and curl characteristics to be adjusted.

The term "film thickness of the photographic constituent layers" in the present invention means a total thickness of photographic constituent layers above a support before processing. Specifically, the thickness can be measured by any one of the following methods. First, a silver halide color photographic light-sensitive material is cut at right angles to a support, and the resultant cut section is measured using an electron microscope. The second method is a method of calculating a film thickness by measuring a difference in thickness between a sample having coated photographic constitutional layers on a support and the support itself.

A film thickness of the photographic constituent layers in the present invention is preferably 8.8 μm or less, more preferably 8.0 μm or less, and most preferably in the range of 7.2 μm to 3.5 μm.

In the present invention, a silver halide emulsion layer containing a yellow dye-forming coupler is coated on a support in either of the position further from or nearer to the support than a silver halide emulsion layer containing a magenta dye-forming coupler or a silver halide emulsion layer containing a cyan dye-forming coupler. Preferably, the silver halide emulsion layer containing a yellow dye-forming coupler is coated on a support in the position further from the support than the silver halide emulsion layer containing a magenta dye-forming coupler or the silver halide emulsion containing a cyan dye-forming coupler. Further, the embodiment that the silver halide emulsion layer containing a yellow dye-forming coupler is coated on the position further-most from a support than any other silver halide emulsion layers, is more preferred from viewpoints of rapid processability and improvement of sharpness. Further, in the present invention, it is preferable that a cyan color-forming coupler-containing silver halide emulsion layer is positioned between a yellow coupler-containing silver halide emulsion layer and a magenta coupler-containing silver halide emulsion layer from a viewpoint of preventing the blix discoloration, whereas the cyan color-forming coupler-containing silver halide emulsion layer is at the position closest to a support (as an undermost layer) from a viewpoint of improving a light fading.

Further, each of the yellow color-forming layer, the magenta color-forming layer and the cyan color-forming layer may be composed of two or three layers. It is also preferable that a coupler-containing layer free from a silver halide emulsion be applied adjacent to a silver halide emulsion layer to form a coloring layer, as described in, for example, JP-A-4-75055, JP-A-9-114035, JP-A-10-246940, and U.S. Pat. No. 5,576,159.

In the present invention, the coating amount of a silver halide emulsion is preferably 0.6 g/m$^2$ or less, but 0.10 g/m$^2$ or more, more preferably 0.55 g/m$^2$ or less, but 0.20 g/m$^2$ or more, and most preferably 0.50 g/m$_2$ or less, but 0.25 g/m$^2$ or more.

Silver halide emulsion grains for use in the cyan-coloring layer and the magenta-coloring layer are preferably cubic grains. The side length thereof is preferably 0.50 μm or less, more preferably from 0.10 μm to 0.40 μm.

In the present invention, it is necessary that the following relations be established with each of the yellow, magenta and cyan images in characteristic curves (sensitocurves) obtained by a 1-second exposure and characteristic curves obtained by a $10^{-4}$-second exposure.

$$0.7 \leqq \log (E_1/E_2) \leqq 1.3, \text{ and}$$

$$0.7 \leqq \log (E'^1/E'_2) \leqq 1.3, \text{ and}$$

$$-0.2 \leqq \log (E'_1/E'_2) - \log (E_1/E_2) \leqq 0.2$$

In the equations, $E_1$ represents an exposure amount necessary to obtain a color density of Dmin+1.8 in each of the characteristic curves of yellow-, magenta-, and cyan-colored images obtained by a 1-second exposure followed by a color processing;

$E_2$ represents an exposure amount necessary to obtain a color density of Dmin+0.02 in each of the characteristic curves of yellow-, magenta-, and cyan-colored images obtained by a 1-second exposure followed by a color processing;

$E'_1$ represents an exposure amount necessary to obtain a color density of Dmin+1.8 in each of the characteristic curves of yellow-, magenta-, and cyan-colored images obtained by a $10^{-4}$-second exposure followed by a color processing;

$E'_2$ represents for an exposure amount necessary to obtain a color density of Dmin+0.02 in each of the characteristic curves of yellow-, magenta-, and cyan-colored images obtained by a $10^{-4}$-second exposure followed by a color processing; and Dmin represents a density obtained by subjecting an unexposed light-sensitive material to a color processing.

When log ($E_1/E_2$) is less than 0.7, the gradation obtained by a low-intensity exposure is excessively hard, so that the image quality of a color print obtained by a surface exposure through a negative becomes an excessively hard gradation.

In contrast, when the log ($E_1/E_2$) is more than 1.3, the gradation is excessively soft, which results in causing problems such as deterioration of sharpness. When the gradation corresponding to a scanning exposure is hard in terms of log ($E'_1/E'_2$)<0.7, or soft in terms of log ($E'^1/E'_2$)>1.3, the exposure amount can be corrected with pixel by pixel in the scanning exposure, from which the surface exposure is different in this point. Consequently, the gradation of a finished color print can be properly corrected. However, the excessively hard gradation causes disappearing (or washing out) of color peculiar to a digital exposure such as the scanning exposure, whereas the excessively soft gradation renders the sharpness markedly worse when the scanning exposure is carried out. Therefore, the optimum region of the gradation as described above also exists in the scanning exposure.

log ($E_1/E_2$) and log ($E'_1/E'_2$) are each preferably in the range of 0.75 to 1.25, more preferably 0.8 to 1.2.

So long as the gradation upon a low-illumination intensity exposure and a high-illumination intensity exposure is in the following range:

$$-0.2 \leqq \log (E'_1/E'_2) - \log (E_1/E_2) \leqq 0.2,$$

photographic properties, such as gradation and sharpness, can be simultaneously satisfied in both the low-illumination intensity exposure and the high-illumination intensity exposure. The value of log ($E'_1/E'_2$)−log ($E_1/E_2$) is preferably in the range of −0.15 to 0.15 with respect to any one of the yellow, magenta, and cyan images, and more preferably in the range of −0.15 to 0.15 with respect to each of the yellow, magenta and cyan images, which range allows the image quality obtained by a low-illumination intensity exposure to coincide with the image quality by a scanning (high-illumination intensity) exposure.

In the present invention, it is necessary that the a maximum optical density in the visible region (400 nm to 800 nm) of a light-sensitive material be in the range of 0.2 to 0.7, in order to obtain a color print exhibiting a reduced remaining color and excellent sharpness. If the maximum optical density is less than 0.2, sharpness clearly deteriorates. On the other hand, if the maximum optical density is more than 0.7, a remaining color is considerable. So, the both cases are not desirable for a color print. The maximum optical density is more preferably in the range of 0.3 to 0.7.

The term "maximum optical density" herein used means the maximum value of optical densities in the wavelength region of 400 to 800 nm, said optical densities being obtained by spectrodensitometric measurement of an unprocessed light-sensitive material in each wavelength.

In the present invention, use of an irradiation-neutralizing dye (anti-irradiation dye) represented by formula (I) is more preferable. In formula (I), as electron-attracting groups having a Hammett's substituent contrast op value of 0.3 or more (preferably 0.8 or less) represented by the above $R^1$ and $R^3$, a carbamoyl group (0.36), a methylcarbamoyl group (0.36), a carboxyl group (0.45), a methoxycarbonyl group (0.45), an ethoxycarbonyl group (0.45), a methylsulfinyl group (0.49), a methylsulfonyl group (0.72), a sulfamoyl group (0.60), a benzoyl group (0.43), an acetyl group (0.50), a trifluoromethyl group (0.54), diethylphosphono group (0.60), a cyano group (0.66), a nitro group (0.78), or the like can be mentioned. Herein, op is described, for example, in "Chemical Reviews" (Vol. 17), pages 125 to 136 (1935). $R^1$ and $R^3$ each represent preferably, a carboxyl group, an alkoxycarbonyl group (e.g., methoxycarbonyl and ethoxycarbonyl), an acyl group (e.g. acetyl and benzoyl), a carbamoyl group (e.g. carbamoyl, methylcarbamoyl, and morpholinocarbamoyl), and an alkoxycarbonyl group or a carbamoyl group is particularly preferable. Further, preferably, $R^1$ and $R^3$ represent the same group.

$R^2$ and $R^4$ are each an alkyl group preferably having 1 to 8 carbon atoms, or an aryl group preferably having 6 to 10 carbon atoms, each of which groups may have a substituent.

At least one of $R^2$ and $R^4$ is preferably an alkyl group having 1 to 8 carbon atoms, which is substituted with at least one sulfo group. Specific examples thereof include a sulfomethyl group, a 2-sulfoethyl group, a 3-sulfopropyl group, a 4-sulfobutyl group, and an o-sulfobenzyl group, each of which groups may further have a substituent. Preferable examples of the substituent include a halogen atom (e.g., fluorine, chlorine, bromine), a hydroxyl group, a carbonyl group, a cyano group, an aryl group having 6 to 7 carbon atoms (e.g., phenyl, p-tolyl), an alkoxy group having 1 to 7 carbon atoms (e.g., methoxy, ethoxy, butoxy), an acyl group having 2 to 7 carbon atoms (e.g., acetyl, benzoyl), an alkoxycarbonyl group having 2 to 7 carbon atoms (e.g., methoxycarbonyl, ethoxycarbonyl), and an amino group having 0 to 7 carbon atoms (e.g., amino, dimethylamino, diethylamino).

Further, at least one of $R^2$ and $R^4$ is preferably an aryl group having 6 to 10 carbon atoms, which is substituted with at least one sulfo group. Specific examples thereof include an o-sulfophenyl group, a m-sulfophenyl group, a p-sulfophenyl group, a 2,5-disulfophenyl group, a 3,5-disulfophenyl group, and a 4,8-disulfo-2-naphthyl group, each of which groups may further have a substituent. Preferable examples of the substituent include a halogen atom (e.g., fluorine, chlorine, bromine), a hydroxyl group, a carboxyl group, a cyano group, an alkyl group having 1 to 4 carbon atoms (e.g., methyl, ethyl, butyl), an alkoxy group having 1 to 4 carbon atoms (e.g., methoxy, ethoxy, butoxy), an acyl group having 2 to 4 carbon atoms (e.g., acetyl), an alkoxycarbonyl group having 2 to 4 carbon atoms (e.g., methoxycarbonyl, ethoxycarbonyl), and an amino group having 0 to 4 carbon atoms (e.g., amino, dimethylamino, diethylamino). $R^2$ and $R^4$ are each more preferably a phenyl group substituted with at least one sulfo group, further more preferably a phenyl group substituted with at least two sulfo groups. Further, it is preferable that $R^2$ and $R^4$ be the same group.

At least one of the methine groups represented by $L^1$, $L^2$, $L^3$, $L^4$ and $L^5$ has a substituent. Preferably any one of the methine groups represented by $L^2$, $L^3$ and $L^4$ has a substituent. Examples of the substituent that the methine groups represented by $L^1$ to $L^5$ may have, include an alkyl group having 1 to 8 carbon atoms, an aryl group having 6 to 10 carbon atoms, an alkoxy group having 1 to 6 carbon atoms (e.g., methoxy, ethoxy), an alkylthio group having 1 to 6 carbon atoms (e.g., methylthio), an arylthio group having 6 to 10 carbon atoms (e.g., phenylthio), an amino group having 0 to 8 carbon atoms (e.g., amino, dimethylamino), and a heterocyclic group, all of which groups may have a substituent, and further include a halogen atom (e.g., chlorine, bromine), a hydroxyl group, a carbonyl group, a sulfo group, and a cyano group. Of these substituents, a heterocyclic group is more preferred. Examples of the heterocyclic group include groups of furanone, benzofuranone, pyrrolinone, pyridone, pyrrolidone, pyrazolone, pyrazolidinedione, isooxazolone, imidazolone, pyrazolopyridone, barbituric acid, rodanine, hydantoin, thiohydantoin, oxyindole, diazaindanone, and coumarin. Of these heterocyclic rings, preferred are benzofuranone, pyridone, pyrazolone, pyrazolidinedione, isooxazolone, imidazolone, pyrazolopyridone, barbituric acid, hydroxyindole, and diazaindanone. Benzofuranone, pyrazolone, pyridone, pyrazolidinedione, and isooxazolone are further preferred. Further, specific examples of the substituent that the above-described groups may have, include not only specific substituents hereinafter described as the substituent which may bond to specifically exemplified groups of the alkyl group and the aryl group recited as a preferable substituent of $L^1$ to $L^5$, but also a heterocyclic group (e.g., 4-pyridyl). As a preferable substituent of the methine group of $L^1$ to $L^5$, an alkyl group having 1 to 8 carbon atoms and an aryl group having 6 to 10 carbon atoms are recited. Preferable examples of the alkyl group having 1 to 8 carbon atoms include methyl, ethyl, propyl, isopropyl, butyl, t-butyl, hexyl, and octyl groups, which may further have a substituent. Preferable examples of the substituent include a halogen atom (e.g., fluorine, chlorine, bromine), a hydroxyl group, a carboxyl group, a sulfo group, a cyano group, an aryl group having 6 to 7 carbon atoms (e.g., phenyl, tolyl), an alkoxy group having 1 to 7 carbon atoms (e.g., methoxy, ethoxy, butoxy), an acyl group having 2 to 7 carbon atoms (e.g., acetyl, benzoyl), an alkoxycarbonyl group having 2 to 7 carbon atoms (e.g., methoxycarbonyl, ethoxycarbonyl), and an amino group having 0 to 7 carbon atoms (e.g., amino, dimethylamino, diethylamino). As a preferable aryl group having 6 to 10 carbon atoms, a phenyl group, a 1-naphthyl group, and a 2-naphthyl group can be exemplified. Further, these groups may have a substituent. Preferable examples of the substituent include a halogen atom (e.g., fluorine, chlorine, bromine), a hydroxyl group, a carboxyl group, a sulfo group, a cyano group, an alkyl group having 1 to 4 carbon atoms (e.g., methyl, ethyl, butyl), an alkoxy group having 1 to 4 carbon atoms (e.g., methoxy, ethoxy, butoxy), an acyl group having 2 to 4 carbon atoms (e.g., acetyl), an alkoxycarbonyl group having 2 to 4 carbon atoms (e.g., methoxycarbonyl, ethoxycarbonyl), and an amino group having 0 to 4 carbon atoms (e.g., amino, dimethylamino, diethylamino).

$M^1$ represents a hydrogen atom, or an atomic group (e.g., ammonium, triethylammonium, pyridinium) or metal atom (e.g., lithium, sodium, potassium), each of which forms a monovalent cation. Of these atoms and groups, preferred are a hydrogen atom, sodium and potassium.

Specific examples of anti-irradiation dyes represented by formula (I) are shown below. However, the present invention should not be limited to these compounds.

TABLE 1

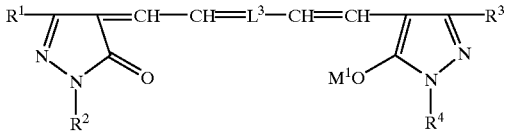

| Compound | $R^1$, $R^3$ | $R^2$, $R^4$ | $L^3$ | $M^1$ |
|---|---|---|---|---|
| D-1 | 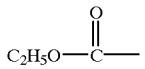 | 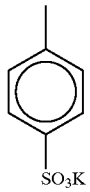 | 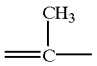 | K |
| D-2 | 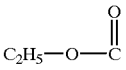 | 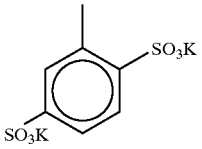 | 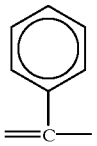 | K |
| D-3 | 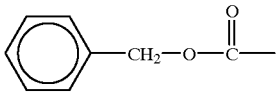 | 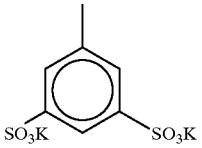 | 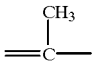 | H |
| D-4 | 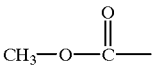 | 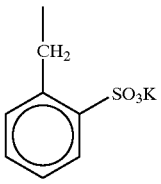 | 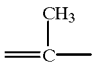 | K |
| D-5 | 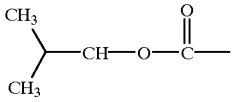 | 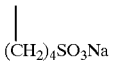 | 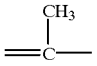 | Na |
| D-6 | 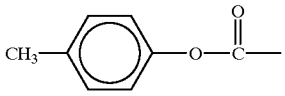 | 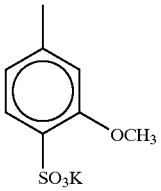 | 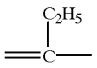 | K |

TABLE 1-continued
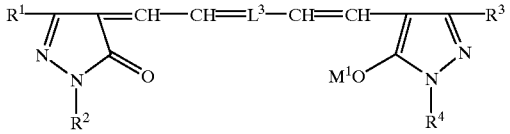
| Compound | $R^1$, $R^3$ | $R^2$, $R^4$ | $L^3$ | $M^1$ |
|---|---|---|---|---|
| D-7 | 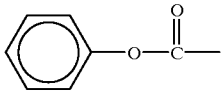 | 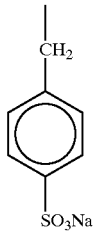 | 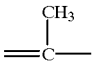 | H |
| D-8 | 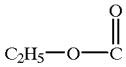 | 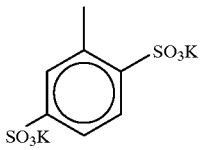 | 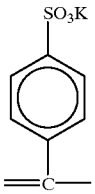 | K |
| D-9 | 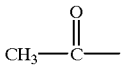 | 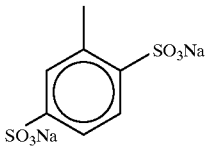 | 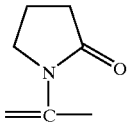 | Na |
| D-10 | 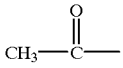 | 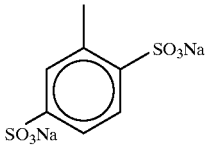 | 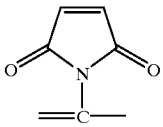 | H |
| D-11 | 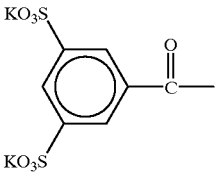 | 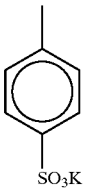 | 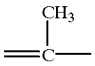 | K |
| D-12 | 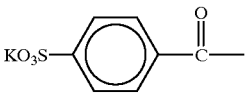 | 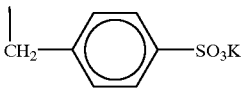 | 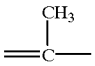 | K |
| D-13 | 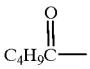 | 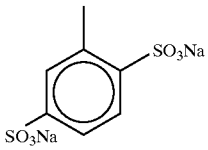 | 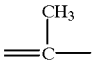 | Na |
| D-14 | 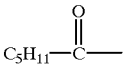 | 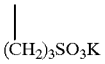 | 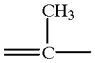 | K |

TABLE 1-continued
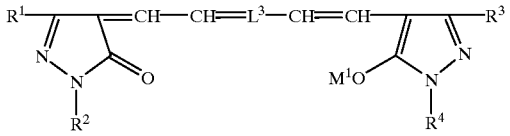
| Compound | $R^1$, $R^3$ | $R^2$, $R^4$ | $L^3$ | $M^1$ |
|---|---|---|---|---|
| D-15 | 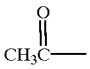 | 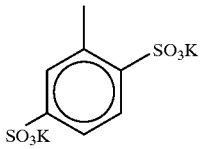 | 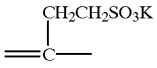 | H |
| D-16 | 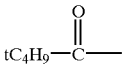 | 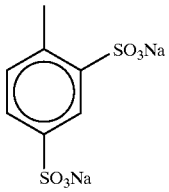 | 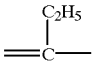 | Na |
| D-17 | 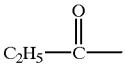 | 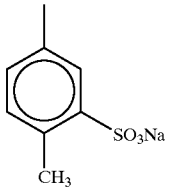 | 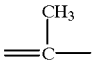 | Na |
| D-18 | KOOC— | 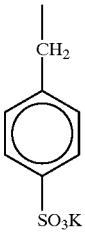 | 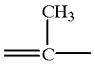 | K |
| D-19 | HOOC— | 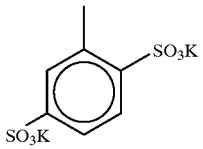 | 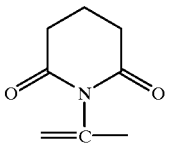 | K |
| D-20 | NaOOC— | 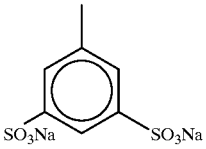 | 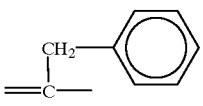 | Na |
| D-21 | 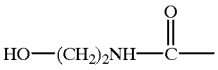 | 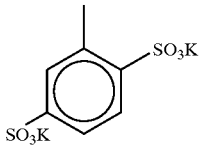 | 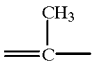 | K |

TABLE 1-continued
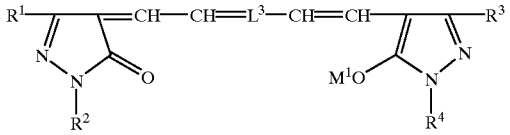
| Compound | $R^1$, $R^3$ | $R^2$, $R^4$ | $L^3$ | $M^1$ |
|---|---|---|---|---|
| D-22 | 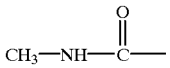 | 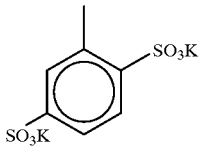 | 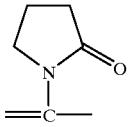 | K |
| D-23 | 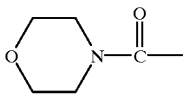 | 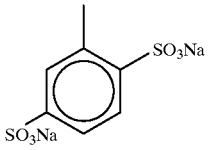 | 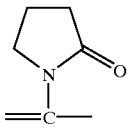 | Na |
| D-24 | 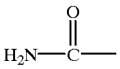 | 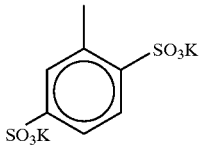 | 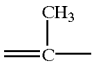 | K |
| D-25 | 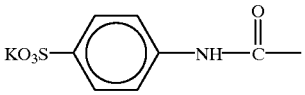 | 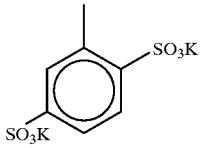 | 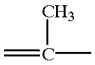 | K |
| D-26 | 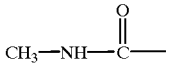 | 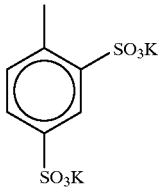 | 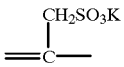 | K |
| D-27 | 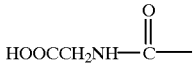 | 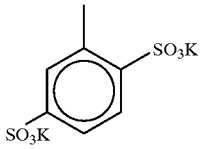 | 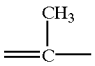 | H |
| D-28 | 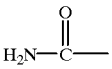 | 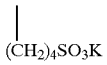 | 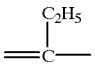 | K |
| D-29 | 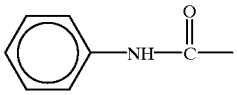 | 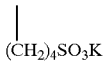 | 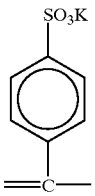 | K |

TABLE 1-continued
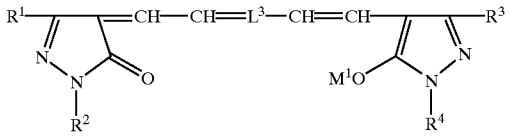
| Compound | $R^1$, $R^3$ | $R^2$, $R^4$ | $L^3$ | $M^1$ |
|---|---|---|---|---|
| D-30 | NC— | 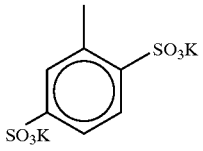 | 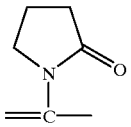 | K |
| D-31 | NC— | 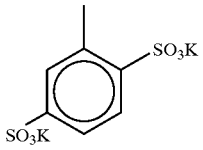 | 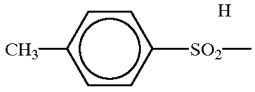 | H |
| D-32 | 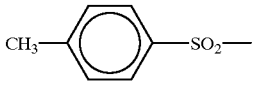 | 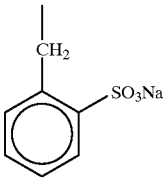 | 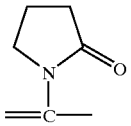 | Na |
| D-33 | $CH_3SO_2$— | 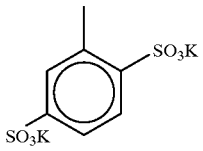 | 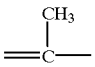 | K |
| D-34 | 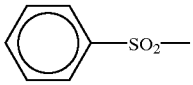 | 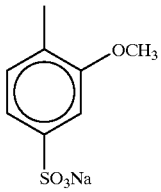 | 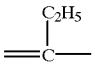 | Na |
| D-35 | $C_4H_9SO_2$— | 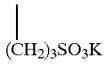 | 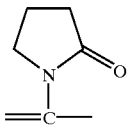 | K |
| D-36 | $C_2H_5NH$—$SO_2$— | 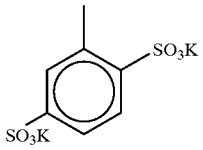 | 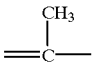 | K |

TABLE 1-continued

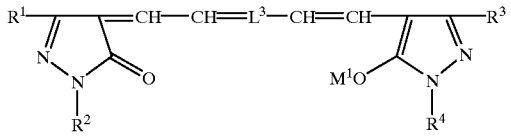

| Compound | $R^1$, $R^3$ | $R^2$, $R^4$ | $L^3$ | $M^1$ |
|---|---|---|---|---|
| D-37 | $CH_3-C(=O)-NH-$ | 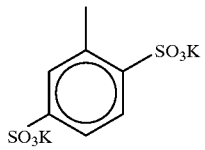 | 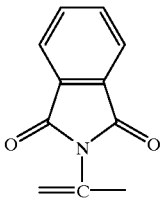 | K |

In the present invention, a metal ion belonging to the VIII group in the periodic table is necessary to be contained in the silver halide grains, to give a high-illumination intensity, short-time exposure suitability. Metal ions can be contained into the silver halide grains by allowing them to be present in a dispersion medium (gelatin, or a polymer which functions as a protective colloid) solution, a halide solution, a silver salt solution, or another aqueous solution, in the form of a metal complex during a formation of the silver halide grains. Further, in the case where a silver bromide localized phase is formed by addition of silver bromide fine grains and/or silver chlorobromide fine grains, it can also be preferred to selectively incorporate a metal ion into the silver bromide localized phase by the use of silver bromide fine grains having previously incorporated metal ion(s).

Examples of these metals include iron, cobalt, nickel, ruthenium, rhodium, iridium and platinum. Of these metals, preferred are iron and ruthenium. More preferably iron or ruthenium is incorporated in centering on a surface layer that is not more than 50% by volume of a silver halide grain, to become richer than the remaining part of the silver halide grain. The term "not more than 50% by volume of a grain" indicates a surface part equivalent to not more than 50% by volume of one grain. The surface part is more preferably 40% or less, and further more preferably 20% or less.

Further, it is preferable that the VIII group metal ion for use in the present invention be used in combination with at least two kinds of metal ions rather than a single use thereof. In the present invention, iron and iridium, or ruthenium and iridium are preferably used in combination. In the case where a silver bromide localized phase exists on an emulsion grain, it is preferred to incorporate a part or all of the iridium ion in the silver bromide localized phase.

Specific examples of iron, ruthenium and iridium compounds which can be used to incorporate in silver halide grains are shown below. However, the present invention should not be limited to these compounds.

(Iron compounds)

ferrous arsenate, ferrous bromide, ferrous carbonate•monohydrate, ferrous chloride, ferrous citrate, ferrous fluoride, ferrous formate, ferrous gluconate, ferrous hydroxide, ferrous iodide, ferrous lactate, ferrous oxalate•dihydrate, ferrous succinate, ferrous sulfate•heptahydrate, ferrous thiocyanate•trihydrate, ferrous nitrate•hexahydrate, ammonium iron (II) nitrate, basic ferric acetate, ferric albuminate, ammonium iron (III) acetate, ferric bromide, ferric chloride, ferric chromate, ferric citrate, ferric fluoride, ferric formate, ferric glycerophosphate, ferric hydroxide, acidic ferric phosphate, ferric nitrate•nonahydrate, ferric phosphate, ferric pyrophosphate, sodium iron (III) pyrophosphate, ferric thiocyanate, ferric sulfate•nonahydrate, ammonium iron (III) sulfate, guanidinium iron (III) sulfate, ammonium iron (III) citrate, potassium hexacyano ferrate (II)•trihydrate, potassium pentacyanoammine ferrate (II), sodium ethylenedinitrilotetraacetato ferrate (III), potassium hexacyano ferrate (III).

(ruthenium compounds)

ruthenium (VI) fluoride, ruthenium (IV) chloride•heptahydrate, potassium hexachlororuthenate (IV), ruthenium (III) chloride, ruthenium (III) bromide, ruthenium (III) iodide, hexaammine ruthenium (III) bromide, chloropentaammine ruthenium (III) chloride, hexaammine ruthenium (II) chloride, potassium hexacyano ruthenate (II)•trihydrate.

(iridium compound)

potassium hexachloro iridate (IV), potassium hexabromo iridate (IV), ammonium hexachloro iridate (IV), iridium (III) bromide•tetrahydrate, iridium (III) iodide, potassium hexachloro iridate (III)•trihydrate, potassium hexabromo iridate (III), potassium tris(oxarato) iridate (III)•tetrahydrate, potassium hexacyano iridate (III), iridium (II) chloride.

Of these compounds, particularly preferred are hexacyano ferrate (II) salts, hexacyano ferrate (III) salts, hexacyano ruthenate (II) salts, hexachloro iridate (IV) salts, hexabromo iridate (IV) salts, hexachloro iridate (III) salts, and hexabromo iridate (III) salts.

The amount to be added of these metal ions belonging to group VIII, though it may change over a wide range in accordance with their intended usage, is preferably $10^{-9}$ mol to $10^{-3}$ mol, and more preferably $10^{-8}$ mol to $5\times10^{-4}$ mol, per mol of silver halide.

In addition to the metal ions belonging to group VIII of the periodic table, other metals, such as copper, gold, zinc, cadmium, and lead, may be contained. These metals may be contained together with the metals of group VIII in the same layer, or they may be contained in a layer free of the metals of group VIII, in accordance with their intended usage. The amount to be added of these metal ions, though it may change over a wide range in accordance with their intended usage, is generally preferably from $10^{-9}$ mol to $10^{-2}$ mol per mol of silver halide.

The silver halide emulsion to be used in the present invention is generally subjected to chemical sensitization. As the chemical sensitization method, sulfur sensitization represented by the addition of an unstable sulfur compound, noble metal sensitization represented by gold sensitization, reduction sensitization, and the like can be used singly or in combination. As the compound to be used in the chemical sensitization, those described in JP-A-62-215272, page 18, right lower column, to page 22, right upper column, are preferably used. Among these compounds, those subjected to gold sensitization are preferable. This is because by subjecting to gold sensitization, fluctuation in photographic performance upon scanning exposure with laser light and the like can be more decreased. To carry out the gold sensitization, a compound, for example, chloroauric acid or its salt, gold thiocyanates, gold thiosulfates, or gold sulfide colloids may be used. The amount of these compounds to be added, though it may be changed in a wide range depending upon the case, is generally $5\times10^{-7}$ to $5\times10^{-3}$ mol and preferable $1\times10^{-6}$ to $1\times10^{-4}$ mol per mol of silver halide. In the present invention, gold sensitization may be combined with another sensitization, such as sulfur sensitization, selenium sensitization, tellurium sensitization, reduction sensitization, and sensitization using a noble metal other than a gold compound. A combination of gold sensitization and sulfur sensitization is preferable.

In the silver halide photographic light-sensitive material of the present invention, other conventionally known photographic materials and additives can be used. For example, a transparent-type base or a reflective-type base can be used as the photographic base (support). As the transparent-type base, a transparent film, such as a cellulose nitrate film and a polyethylene terephthalate film; and one wherein a film, for example, of a polyester of 2,6-naphthalenedicarboxylic acid (NDCA) and ethylene glycol (EG) or a polyester of NDCA, terephthalic acid, and EG, is provided with an information recording layer, such as a magnetic layer, are preferably used. As a reflective-type base, particularly, a reflective-type base, wherein a laminate has a plurality of polyethylene layers or polyester layers and wherein at least one of such water-resistant resin layers (laminated layers) contains a white pigment, such as titanium oxide, is preferable.

Further, the above water-resistant resin layers preferably contain a fluorescent whitening agent. Further, a fluorescent whitening agent may be dispersed in the hydrophilic colloid layer of the light-sensitive material. As the fluorescent whitening agent, preferably a benzoxazole-series fluorescent whitening agent, a cumarin-series fluorescent whitening agent, or a pyrazoline-series fluorescent whitening agent can be used, and more preferably a benzoxazolylnaphthalene-series fluorescent whitening agent or a benzoxazolylstilbene-series fluorescent whitening agent is used. The amount to be used is not particularly limited, but preferably it is 1 to 100 mg/m$^2$. When it is mixed with a water-resistant resin, preferably the mixing proportion is 0.0005 to 3% by weight, and more preferably 0.001 to 0.5% by weight, to the resin. The reflective-type base may be one wherein a hydrophilic colloid layer containing a white pigment is applied on a transparent-type base or a reflective-type base described in the above. Further, the reflective-type base may be a base having a specular reflective- or a second-type diffusion reflective metal surface.

For the above reflective-type base, silver halide emulsions, as well as different metal ion species to be doped into silver halide grains, antifoggants or storage stabilizers of silver halide emulsions, chemical sensitizing methods (sensitizers), and spectrally sensitizing methods (spectral sensitizers) for silver halide emulsions, cyan, magenta, and yellow couplers and methods for emulsifying and dispersing them, dye-image-preservability improving agents (antistaining agents and anti-fading agents), dyes (colored layers), gelatins, layer structures of light-sensitive materials, the pH of coatings of light-sensitive materials, and the like, those described in the patents shown in Table 2 can be preferably applied in the present invention.

TABLE 2

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |

TABLE 2-continued

| Element | JP-A-7-104448 | JP-A-7-77775 | JP-A-7-301895 |
|---|---|---|---|
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers additionally used in the present invention, further, couplers described in JP-A-62-215272, page 91, right upper column, line 4 to page 121, left upper column, line 6; JP-A-2-33144, page 3, right upper column, line 14 to page 18, left upper column, the last line, and page 30, right upper column, line 6 to page 35, right lower column, line 11; and EP-A-0 355 660 (A2), page 4, line 15 to line 27, page 5, line 30 to page 28, the last line, page 45, line 29 to line 31, and page 47, line 23 to page 63, line 50, are also useful.

In the present invention, known color-mixing preventing agents may be used. Among the agents, those described in the following patents are preferable.

For example, high molecular weight redox compounds described in JP-A-5-333501, phenidone- or hydrazine-series compounds described in WO 98/33760 and U.S. Pat. No. 4,923,787, and white couplers described in JP-A-5-249637, JP-A-10-282615 and German Patent No. 19629142A1 may be used. In order to raise the pH of a developing solution and to promote developing rate in particular, it is preferable to use redox compounds described in German Patent No. 19618786A1, E.P. Patent Nos. 839623A1 and 842975A1, German Patent No. 19806846A1, and France Patent No. 276046A1.

In the present invention, it is preferable to use, as a UV-ray absorber, a compound having a triazine skeleton with a high molar extinction coefficient. For example, the compounds described in the following patents can be used.

Specifically, can be mentioned the compounds described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, E.P.Patent No. 711804A, and JP-T-8-501291 ("JP-T" means published searched patent publication).

As fungiproofing/mildewproofing agents that can be used in the present invention, those described in JP-A-63-271247 are useful. As a hydrophilic colloid used in photographic layers that constitute the light-sensitive material, gelatin is preferable, and in particular, preferably heavy metals contained as impurities, such as iron, copper, zinc, and manganese are 5 ppm or less and more preferably 3 ppm or less. Also, preferably calcium content in the light-sensitive material is 20 mg/$m^2$ or less, more preferably 10 mg/$m^2$ or less, most preferably 5 mg/$m^2$ or less.

The light-sensitive material of the present invention is for use in not only printing systems that use usual negative printers, it is also suitable for scanning exposure systems using cathode rays (CRT). In comparison with apparatuses using lasers, cathode ray tube exposure apparatuses are simple and compact and make the cost low. Further, the adjustment of optical axes and colors is easy. For the cathode ray tubes used for image exposure, use is made of various emitters that emit light in spectral regions as required. For example, any one of, or a mixture of two or more of, a red emitter, a green emitter, and a blue emitter may be used. The spectral region is not limited to the above red, green, and blue, and an emitter that emits a color in the yellow, orange, purple, or infrared region may also be used. In particular, a cathode ray tube that emits white light by mixing these phosphors is often used.

When the light-sensitive material has multiple light-sensitive layers different in spectral sensitivity distributions, and the cathode ray tube has phosphors that show light emission in multiple spectral regions, multiple colors may be exposed at a time; namely, image signals of multiple colors are inputted into the cathode ray tube, to emit lights from the tube surface. A method in which exposure is made in such a manner that image signals for respective colors are inputted successively, to emit the respective colors successively, and they are passed through films for cutting out other colors (surface-successive exposure), may be employed, and generally the surface-successive exposure is preferred to make image quality high, since a high-resolution cathode ray tube can be used.

The light-sensitive material of the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is preferable to use a semiconductor laser for at least one of the exposure light sources.

If such a scanning exposure light source is used, the spectral sensitivity maximum wavelength of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three wavelength regions, the blue region, the green region and the red region. If the exposure time in this scanning exposure is defined as the time for which a picture element size is exposed to light with the density of the picture element being 400 dpi, preferably the exposure time is $10^{-4}$ sec or less, more preferably $10^{-6}$ sec or less.

Preferable scanning exposure systems that can be applied to the present invention are described in detail in the patents listed in the above Table. Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patents listed in the above Table are preferably used.

As the systems for conducting development of the light-sensitive material of the present invention after the exposure thereof, a wet system, such as the conventional method, in which development is carried out by using a developing solution containing an alkali agent and a developing agent, and a method in which a developing agent is built in the light-sensitive material and the development is carried out by using an activator solution, such as an alkali solution, free from any developing agent, as well as a heat development system that does not use a processing solution, can be used. Particularly, since the activator method does not contain a developing agent in the processing solution, the control and the handling of the processing solution are easy, and the load at the time of waste liquor treatment is less, which makes the activator method preferable in view of environmental conservation. In the activator method, as the developing agent or its precursor to be built in the light-sensitive material, for example, hydrazine-type compounds described in JP-A-8-234388, JP-A-9-152686, JP-A-9-152693, JP-A-9-211814, and JP-A-9-160193 are preferable.

Further, a development method in which the coated amount of silver in the light-sensitive material is decreased, and an image intensification processing (intensification processing) is carried out using hydrogen peroxide, is also preferably used. Particularly, it is preferable to use this method for the activator method. Specifically, preferably use is made of image-forming methods described in JP-A-8-297354 and JP-A-9-152695, wherein an activator solution containing hydrogen peroxide is used. In the activator method, after the processing with an activator solution, a desilvering process is generally carried out, but in the image intensifying process in which a light-sensitive material with the amount of silver lowered is used, the desilvering process can be omitted, and a simple process, such as a washing process or a stabilizing process, can be carried out. Further, in a system in which image information is read from a light-sensitive material by a scanner or the like, a processing mode without requiring a desilvering process can be employed, even when a light-sensitive material having a large amount of silver, such as a light-sensitive material for shooting (photographing), is used.

As the activator solution, the desilvering solution (bleach/fix solution), the processing material of washing and stabilizing solution, and the processing method that are used in the present invention, known ones can be used. Preferably, those described in Research Disclosure Item 36544 (September 1994), pages 536 to 541, and JP-A-8-234388, can be used.

In the present invention, the term "color-developing time" means a period of time required from the beginning of dipping of a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material after departure from the color developing solution has been conveyed in the air toward a bleach-fixing bath in the step subsequent to color development (so-called "time in the air"). Similarly the term "bleach-fixing time" means a period of time required from the beginning of dipping of a light-sensitive material into a bleach-fixing solution until the light-sensitive material is dipped into a washing or stabilizing bath in the subsequent processing step. Further, the term "washing or stabilizing time" means a period of time in which a light-sensitive material is staying in the washing or stabilizing solution until it begins to be conveyed toward a drying step (so-called "time in the solution").

In the rapid processing which is an object of the present invention to be achieved, the color developing time can be made 50 seconds or less, and the time is preferably 30 seconds or less, more preferably 20 seconds or less, and most preferably in the range of 15 seconds to 6 seconds. Similarly the bleach-fixing time is preferably 30 seconds or less, more preferably 20 seconds or less, and most preferably in the range of 15 seconds to 6 seconds. Further, the washing or stabilizing time is preferably 40 seconds or less, more preferably 30 seconds or less, and most preferably in the range of 20 seconds to 6 seconds.

The light-sensitive material of the present invention is excellent in rapid-processability and sharpness, and it also has good suitability for both surface exposure and high-illumination-intensity scanning exposure, so that an excellent image can be obtained by any type of processing methods, in the above-described color-developing time.

The silver halide color photographic light-sensitive material of the present invention has excellent rapid-processability and minimized remaining color. Further, the light-sensitive material of the invention exhibits an excellent effect, that an image having excellent sharpness can be obtained even though a color print is produced by each of a surface exposure and a high-illumination-intensity scanning exposure. According to the image-forming method of the present invention that uses the above-described light-sensitive material, an image exhibiting minimized remaining color and excellent sharpness can be obtained by a rapid processing in either of a surface exposure or a high-illumination-intensity scanning exposure.

The present invention will be described in more detail with reference to examples, but the present invention is not restricted to them.

EXAMPLES

Example 1

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers, to prepare a sample (101) of a silver halide color photographic light-sensitive material having the layer configuration shown below. The coating solutions for each photographic constitutional layer were prepared as follows.

Preparation of Fifth-Layer Coating Solution 260 g of a cyan coupler (ExC-2), 60 g of a cyan coupler (ExC-3), 30 g of a color-image-stabilizer (Cpd-6), 5.8 g of a color-image-stabilizer (Cpd-7), 2.0 g of a color-image-stabilizer (Cpd-9), 31.5 g of a color-image-stabilizer (Cpd-14), 31.5 g of a color-image-stabilizer (Cpd-15), 45.5 g of a color-image-stabilizer (Cpd-17), 45.5 g of a color-image-stabilizer (Cpd-18), and 40 g of an ultraviolet absorbing agent (UV-7), were dissolved in 65.5 g of a solvent (Solv-5) and 350 ml of ethyl acetate, and the resulting solution was emulsified and dispersed in 6500 g of a 10% aqueous gelatin solution containing 25 g of a surface-active agent (Cpd-20), to prepare an emulsified dispersion C.

On the other hand, a silver chlorobromide emulsion C (cubes, a mixture of a large-size emulsion C having an average grain size of 0.40 $\mu$m, and a small-size emulsion C having an average grain size of 0.30 $\mu$m (5:5 in terms of mol of silver), the deviation coefficients of the grain size distributions being 0.09 and 0.11 respectively. 0.2 mol % of silver chlorobromide (silver bromide content: 50 mol %) was added to the large-size emulsion so that the silver chlorobromide could be localized on a part of the surface of each grain comprising silver chloride as a substrate, and likewise 0.3 mol % of the silver chlorobromide was added to the small-size emulsion. Potassium hexacyano ferrate (II) was incorporated in the surface layer accounting for 20% by volume of an emulsion grain, in the amount of $1.0\times10^{-6}$ mol for the large-size emulsion, and $1.8\times10^{-6}$ mol for the small-size emulsion, respectively. Potassium hexachloro iridate (IV) was incorporated in the silver chlorobromide localized phase on the surface of each grain as described above, in the amount of $1.0\times10^{-8}$ mol for the large-size emulsion, and $2.5\times10^{-8}$ mol for the small-size emulsion, respectively. The molar amount herein used indicates a content in terms of 1 mol of silver in the emulsion.) was prepared.

To the large-size emulsion C of this emulsion, had been added $1.5\times10^{-5}$ mol, per mol of silver, of each of red-sensitive sensitizing dyes G and H shown below, and to the small-size emulsion C of this emulsion, had been added $2.0\times10^{-5}$ mol, per mol of silver, of each of red-sensitive sensitizing dyes G and H shown below. The chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. The coating amount of the emulsion is in terms of silver.

The coating solutions for the first layer to fourth layer and the sixth layer to seventh layer were prepared in the similar manner as that for the fifth layer coating solution. As the gelatin hardener for each layer, H-1, H2, and H-3 was used.

Further, to each layer, were added Ab-1, Ab-2, Ab-3, and Ab-4, so that the total amounts would be 15.0 mg/m$^2$, 60.0 mg/m$^2$, 5.0 mg/m and 10.0 mg/m$^2$, respectively.

(H-1) Hardener

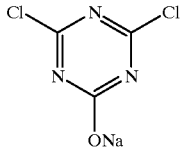

(used in 0.50 wt % per gelatin)

(H-2) Hardener

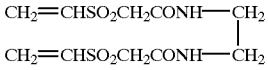

(used in 1.20 wt % per gelatin)

(H-3) Hardener

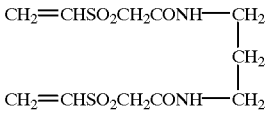

(used in 0.40 wt % per gelatin)

(Ab-1) Antiseptic

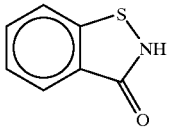

(Ab-2) Antiseptic

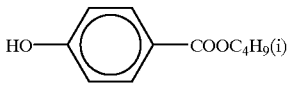

(Ab-3) Antiseptic

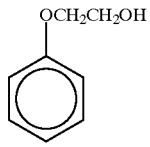

-continued (Ab-4) Antiseptic

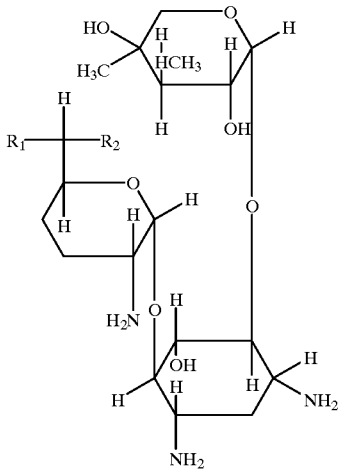

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, d

For the silver chlorobromide emulsion of each photosensitive emulsion layer, the following spectral sensitizing dyes were used.

(Sensitizing dye D)

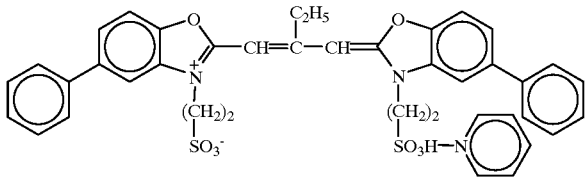

(Sensitizing dye F)

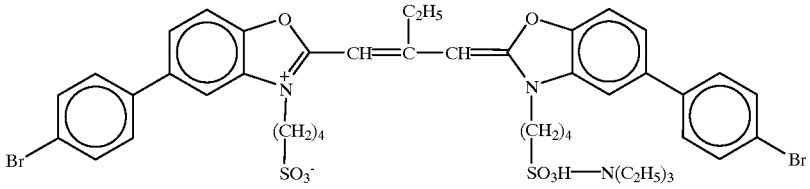

Blue-Sensitive Emulsion Layer (Sensitizing dye A)

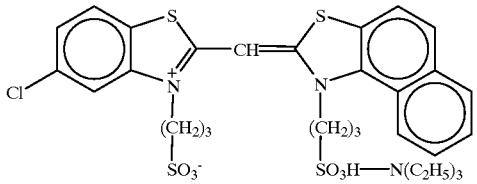

(Sensitizing dye B)

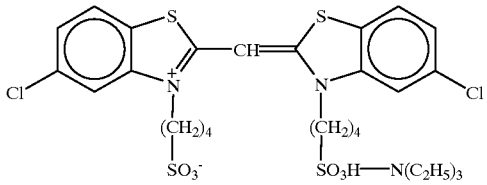

(Sensitizing dye C)

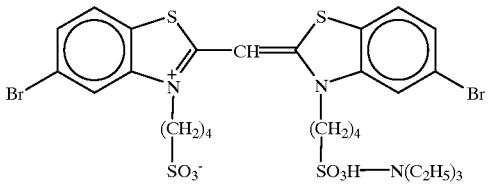

(The sensitizing dyes A and C were added, respectively, to the large-size emulsion, in an amount of $0.42\times10^{-4}$ mol per mol of the silver halide, and to the small-size emulsion in an amount of $0.50\times10^{-4}$ mol per mol of the silver halide. The sensitizing dyes B was added, to the large-size emulsion, in an amount of $3.4\times10^{-4}$ mol per mol of the silver halide, and to the small-size emulsion in an amount of $4.1\times10^{-4}$ mol per mol of the silver halide.)

Green-Sensitive Emulsion Layer (Sensitizing dye E)

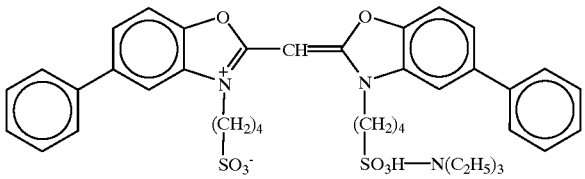

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

Red-Sensitive Emulsion Layer (Sensitizing dye G)

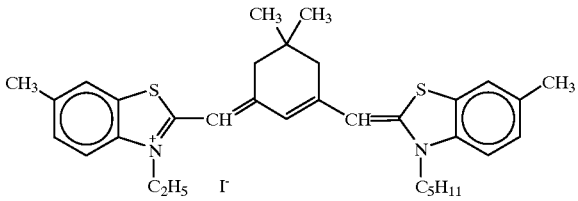

(Sensitizing dye H)

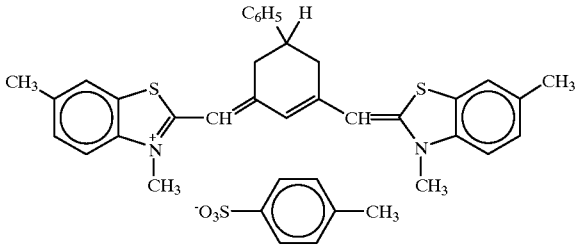

(The sensitizing dyes G and H were added, receptively, to the large-size emulsion, in an amount of $8.0\times10^{-5}$ mol per mol of the silver halide, and to the small-size emulsion in an amount of $10.7\times10^{-5}$ mol per mol of the silver halide. Further, the following Compound I was added to the red-sensitive emulsion layer, in an amount of $3.0\times10^{-3}$ mol, per mol of the silver halide.)

(Compound I)

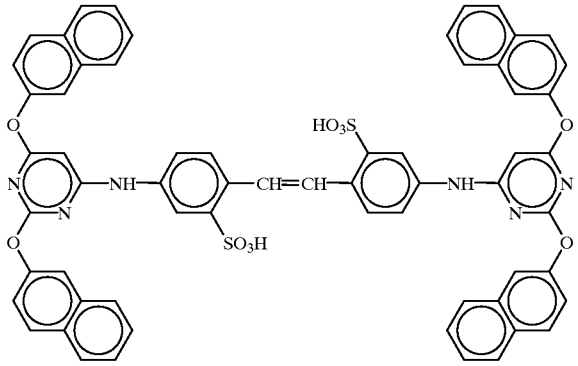

Further, to the blue-sensitive emulsion layer, the green-sensitive emulsion layer, and the red-sensitive emulsion layer, was added 1-(3-methylureidophenyl)-5mercaptotetrazole in amounts of $3.3\times10^{-4}$ mol, $1.0\times10^{-3}$ mol, and $5.9\times10^{-4}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer latex of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the dyes of I-1 to I-3 were added (the coating amount is shown in parentheses).

I-1

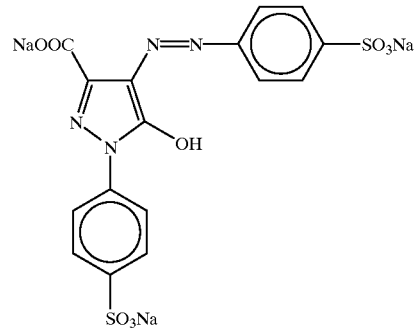

(4 mg/m$^2$)

I-2

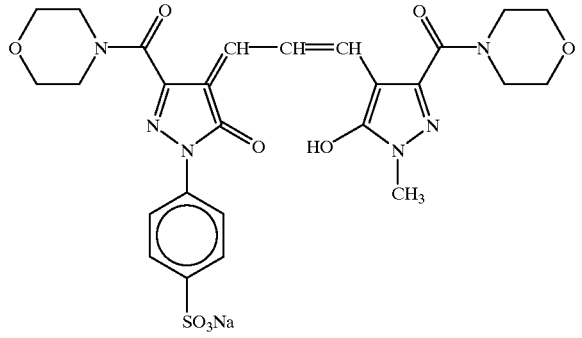

(8 mg/m$^2$)

I-3

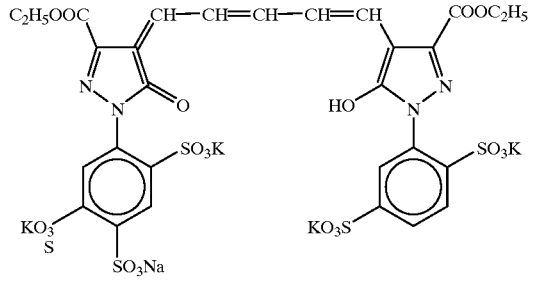

(40 mg/m$^2$)

Layer Constitution

The composition of each layer is shown below. The numbers show coating amounts (g/m$^2$). In the case of the silver halide emulsion, the coating amount is in terms of silver.

Base

Polyethylene Resin-Laminated Paper

[The polyethylene resin on the first layer side contained a white pigment ($TiO_2$: content of 16 wt %, ZnO: content of 4 wt %), a fluorescent whitening agent (4,4'-bis(5-methylbenzoxazoryl)stilbene: content of 0.03 wt %), and a blue dye (ultramarine)]

| | |
|---|---|
| First Layer (Blue-Sensitive Emulsion Layer) | |
| A silver chlorobromide emulsion A (Cubes, a mixture of a large-size emulsion A having an average grain size of 0.72 μm, and a small-size emulsion A having an average grain size of 0.60 μm (5:5 in terms of mol of silver). The deviation coefficients of the grain size distributions were 0.08 and 0.10, respectively, and each emulsion had 0.10 mol % and 0.18 mol %, respectively, of a silver chlorobromide (AgBr: content of 50 mol %) locally contained in part of the grain surface whose substrate was made up of silver chloride.) | 0.24 |
| Gelatin | 1.40 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 1.00 |
| Color-mixing inhibitor (Cpd-4) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| Third Layer (Green-Sensitive Emulsion Layer) | |
| A silver chlorobromide emulsion B (Cubes, a mixture of a large-size emulsion B having an average grain size of 0.45 μm, and a small-size emulsion B having an average grain size of 0.35 μm (1:3 in terms of mol of silver). The deviation coefficients of the grain size distributions were 0.10 and 0.08, respectively, and each emulsion had 0.18 mol % and 0.25 mol %, respectively, of a silver chlorobromide (AgBr: content of 50 mol %) locally contained in part of the grain surface whose substrate was made up of silver chloride.) | 0.14 |
| Gelatin | 1.20 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Inhibiting Layer) | |
| Gelatin | 0.93 |
| Color-mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | 0.12 |
| A silver chlorobromide emulsion C (Cubes, a mixture of a large-size emulsion C having an average grain size of 0.40 μm, and a small-size emulsion C having an average grain size of 0.30 μm (5:5 in terms of mol of silver). The deviation coefficients of the grain size distributions were 0.09 and 0.11, respectively.) | |

-continued

| | |
|---|---|
| Gelatin | 1.39 |
| Cyan coupler (ExC-2) | 0.13 |
| Cyan coupler (ExC-3) | 0.03 |
| Color-image stabilizer (Cpd-6) | 0.015 |
| Color-image stabilizer (Cpd-7) | 0.003 |
| Color-image stabilizer (Cpd-9) | 0.01 |
| Color-image stabilizer (Cpd-14) | 0.016 |
| Color-image stabilizer (Cpd-15) | 0.016 |
| Color-image stabilizer (Cpd-17) | 0.023 |
| Color-image stabilizer (Cpd-18) | 0.023 |
| Ultraviolet absorbing agent (UV-7) | 0.02 |
| Solvent (Solv-5) | 0.033 |
| Sixth Layer (Ultraviolet Absorbing Layer) | |
| Gelatin | 0.60 |
| Ultraviolet absorbing agent (UV-C) | 0.42 |
| Solvent (Solv-7) | 0.08 |
| Seventh Layer (Protective Layer) | |
| Gelatin | 1.18 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylcyloxane | 0.01 |
| Silicon dioxide | 0.003 |

(ExY) Yellow coupler

A mixture in 70:30 (molar ratio) of

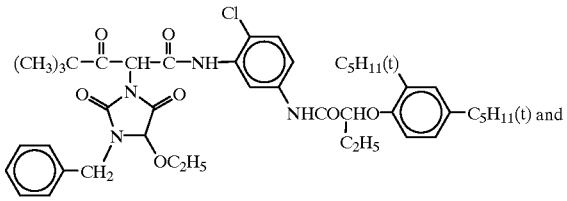

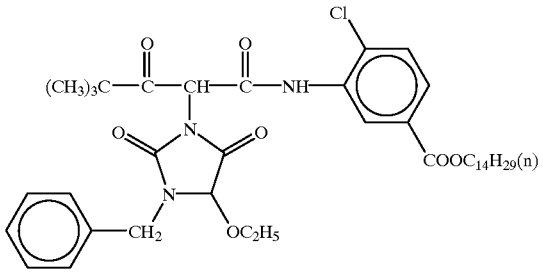

(ExM) Magenta coupler

A mixture in 40:40:20 (molar ratio) of

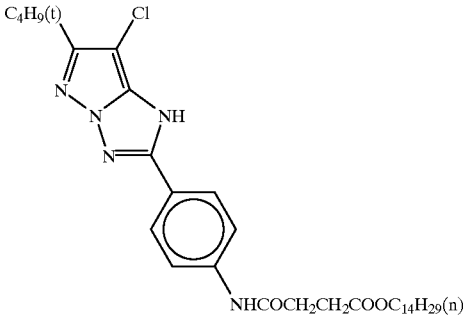

and

-continued
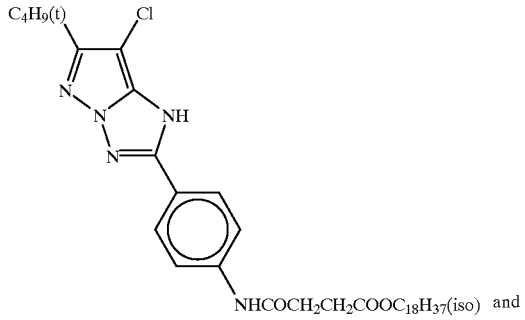
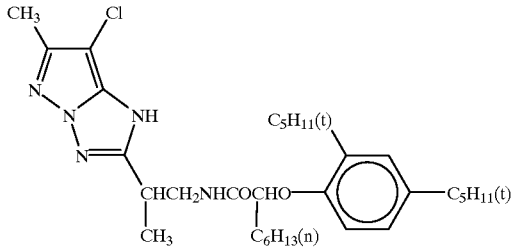
(ExC-2) Cyan coupler
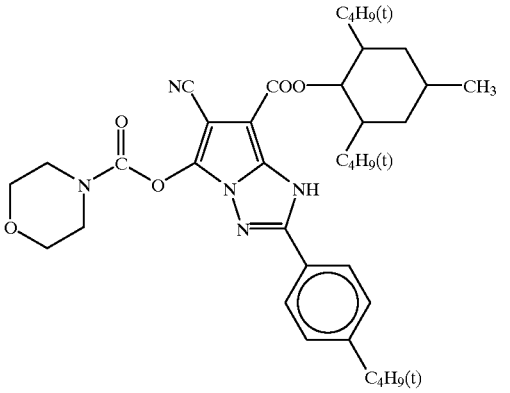
(ExC-3) Cyan coupler
A mixture in 50:25:25 (molar ratio) of
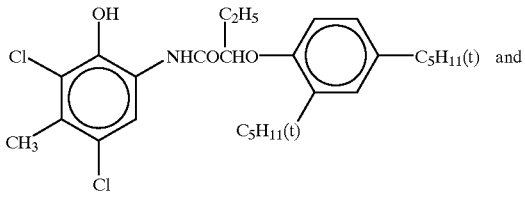
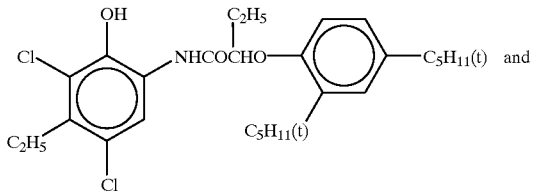
-continued
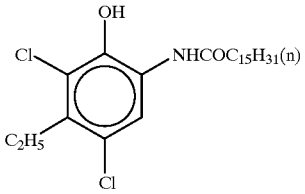
(Cpd-1) Color-image stabilizer
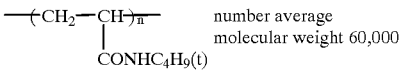
(Cpd-2) Color-image stabilizer
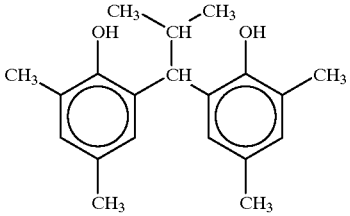
(Cpd-3) Color-image stabilizer
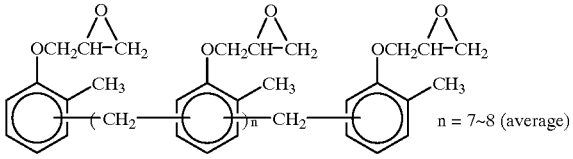
(Cpd-4) Color-mixing inhibitor
A mixture in 1:1 (molar ratio) of
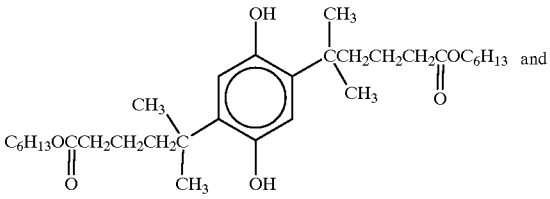
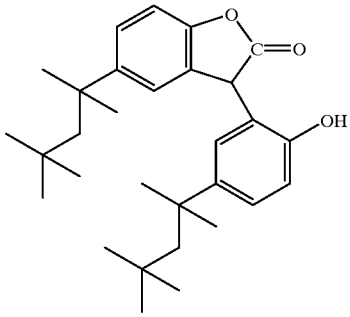
(Cpd-5) Color-mixing inhibiting auxiliary
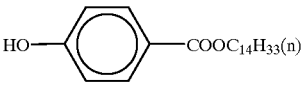

-continued
(Cpd-6) Stabilizer
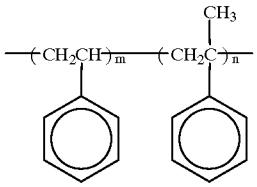
(Cpd-7) Color-mixing inhibitor
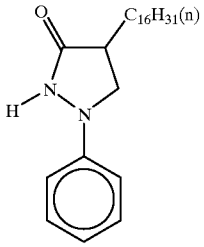
(Cpd-8) Color-image stabilizer
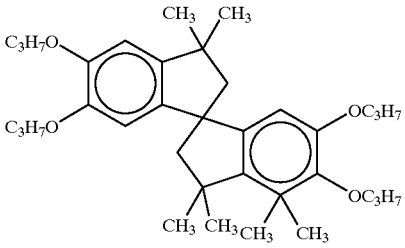
(Cpd-9) Color-image stabilizer
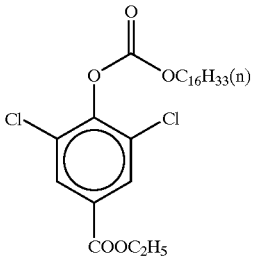
(Cpd-10) Color-image stabilizer
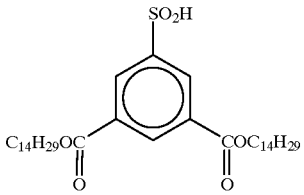
(Cpd-11)
-continued
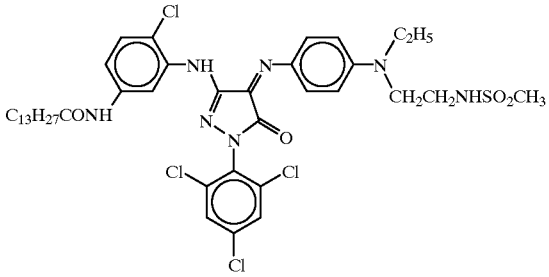
(Cpd-13) Surface-active agent
A mixture in 7:3 (molar ratio) of
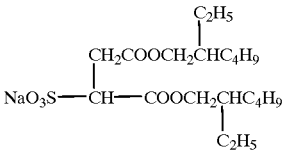
and
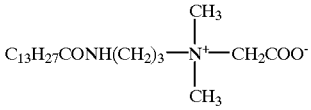
(Cpd-14)
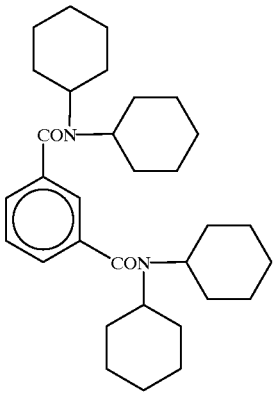
(Cpd-15)
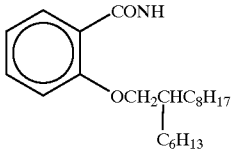
(Cpd-17)
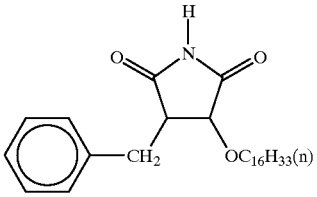
(Cpd-18)

-continued

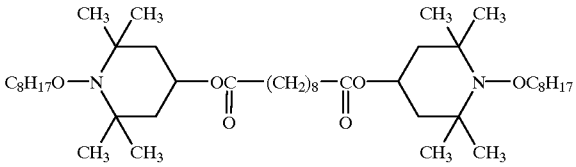

(Cpd-20) Surface-active agent
A mixture in 1:4 (molar ratio) of

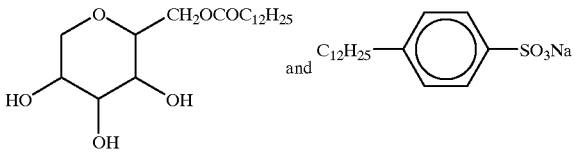

(UV-1) Ultra-violet absorbent

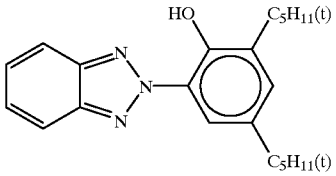

(UV-2) Ultra-violet absorbent

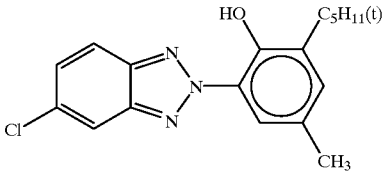

(UV-3) Ultra-violet absorbent

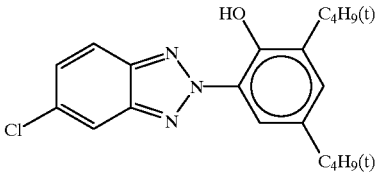

(UV-4) Ultra-violet absorbent

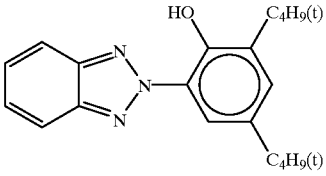

(UV-6) Ultra-violet absorbent

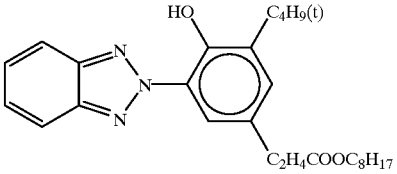

-continued (UV-7) Ultra-violet absorbent

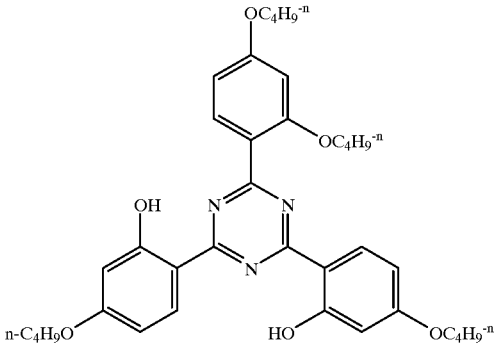

UV-A: A mixture of UV-1/UV-2/UV-3/UV-4 = 4/2/2/3 (weight ratio)
UV-C: UV-2/UV-3/UV-6/UV-7 = 1/1/1/2 (weight ratio)

(Solv-1)

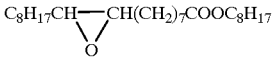

(Solv-3)

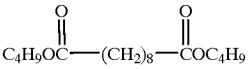

(Solv-4)

$O{=}P{-}(OC_6H_{13}(n))_3$ (Solv-5)

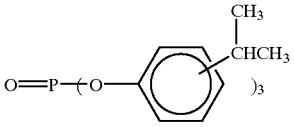

(Solv-7)

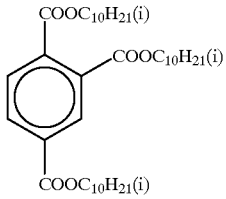

Samples (102) and (103) were prepared in the same manner as sample (101), except for changing the coating amount of anti-irradiation dyes I-1 to I-3.

Samples (104) to (124) were prepared in the same manner as samples (101) to (103) respectively, except for changing the content of each of potassium hexacyano ferrate (II) and potassium hexachloro iridata (IV) in the silver chlorobromide emulsion, and/or the coating amount of gelatin, of these samples. Table 3 shows each of the above-described metal ion content contained in the emulsion of each sample, the gelatin-coating amount, the anti-irradiation dye-coating amount, and the film thickness.

TABLE 3

| Sample | Blue-sensitive emulsion layer | | | | Green-sensitive emulsion layer | | | |
|---|---|---|---|---|---|---|---|---|
| | large size | | small size | | large size | | small size | |
| No. | iron ion | iridium ion | iron ion | iridium ion | iron ion | iridium ion | iron ion | iridium ion |
| 101 | $5.0 \times 10^{-7}$ | $5.5 \times 10^{-9}$ | $7.0 \times 10^{-7}$ | $8.0 \times 10^{-9}$ | $6.0 \times 10^{-7}$ | $7.0 \times 10^{-9}$ | $7.5 \times 10^{-7}$ | $1.5 \times 10^{-8}$ |
| 102 | $5.0 \times 10^{-7}$ | $5.5 \times 10^{-9}$ | $7.0 \times 10^{-7}$ | $8.0 \times 10^{-9}$ | $6.0 \times 10^{-7}$ | $7.0 \times 10^{-9}$ | $7.5 \times 10^{-7}$ | $1.5 \times 10^{-8}$ |
| 103 | $5.0 \times 10^{-7}$ | $5.5 \times 10^{-9}$ | $7.0 \times 10^{-7}$ | $8.0 \times 10^{-9}$ | $6.0 \times 10^{-7}$ | $7.0 \times 10^{-9}$ | $7.5 \times 10^{-7}$ | $1.5 \times 10^{-8}$ |
| 104 | $5.0 \times 10^{-7}$ | $5.5 \times 10^{-9}$ | $7.0 \times 10^{-7}$ | $8.0 \times 10^{-9}$ | $6.0 \times 10^{-7}$ | $7.0 \times 10^{-9}$ | $7.5 \times 10^{-7}$ | $1.5 \times 10^{-8}$ |
| 105 | $5.0 \times 10^{-7}$ | $5.5 \times 10^{-9}$ | $7.0 \times 10^{-7}$ | $8.0 \times 10^{-9}$ | $6.0 \times 10^{-7}$ | $7.0 \times 10^{-9}$ | $7.5 \times 10^{-7}$ | $1.5 \times 10^{-8}$ |
| 106 | $5.0 \times 10^{-7}$ | $5.5 \times 10^{-9}$ | $7.0 \times 10^{-7}$ | $8.0 \times 10^{-9}$ | $6.0 \times 10^{-7}$ | $7.0 \times 10^{-9}$ | $7.5 \times 10^{-7}$ | $1.5 \times 10^{-8}$ |
| 107 | $1.5 \times 10^{-6}$ | $1.8 \times 10^{-8}$ | $2.0 \times 10^{-6}$ | $2.0 \times 10^{-8}$ | $1.8 \times 10^{-6}$ | $2.0 \times 10^{-8}$ | $2.3 \times 10^{-6}$ | $3.5 \times 10^{-8}$ |
| 108 | $1.5 \times 10^{-6}$ | $1.8 \times 10^{-8}$ | $2.0 \times 10^{-6}$ | $2.0 \times 10^{-8}$ | $1.8 \times 10^{-6}$ | $2.0 \times 10^{-8}$ | $2.3 \times 10^{-6}$ | $3.5 \times 10^{-8}$ |
| 109 | $1.5 \times 10^{-6}$ | $1.8 \times 10^{-8}$ | $2.0 \times 10^{-6}$ | $2.0 \times 10^{-8}$ | $1.8 \times 10^{-6}$ | $2.0 \times 10^{-8}$ | $2.3 \times 10^{-6}$ | $3.5 \times 10^{-8}$ |
| 110 | $1.5 \times 10^{-6}$ | $1.8 \times 10^{-8}$ | $2.0 \times 10^{-6}$ | $2.0 \times 10^{-8}$ | $1.8 \times 10^{-6}$ | $2.0 \times 10^{-8}$ | $2.3 \times 10^{-6}$ | $3.5 \times 10^{-8}$ |
| 111 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 112 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 113 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 114 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 115 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 116 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 117 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 118 | $3.0 \times 10^{-6}$ | $3.3 \times 10^{-8}$ | $4.0 \times 10^{-6}$ | $5.0 \times 10^{-8}$ | $5.0 \times 10^{-6}$ | $4.5 \times 10^{-8}$ | $6.5 \times 10^{-6}$ | $7.0 \times 10^{-8}$ |
| 119 | $3.0 \times 10^{-6}$ | $1.0 \times 10^{-7}$ | $4.0 \times 10^{-6}$ | $1.5 \times 10^{-7}$ | $5.0 \times 10^{-6}$ | $1.3 \times 10^{-7}$ | $6.5 \times 10^{-6}$ | $1.8 \times 10^{-7}$ |
| 120 | $3.0 \times 10^{-6}$ | $1.0 \times 10^{-7}$ | $4.0 \times 10^{-6}$ | $1.5 \times 10^{-7}$ | $5.0 \times 10^{-6}$ | $1.3 \times 10^{-7}$ | $6.5 \times 10^{-6}$ | $1.8 \times 10^{-7}$ |
| 121 | $3.0 \times 10^{-6}$ | $1.0 \times 10^{-7}$ | $4.0 \times 10^{-6}$ | $1.5 \times 10^{-7}$ | $5.0 \times 10^{-6}$ | $1.3 \times 10^{-7}$ | $6.5 \times 10^{-6}$ | $1.8 \times 10^{-7}$ |
| 122 | $3.0 \times 10^{-6}$ | $1.0 \times 10^{-7}$ | $4.0 \times 10^{-6}$ | $1.5 \times 10^{-7}$ | $5.0 \times 10^{-6}$ | $1.3 \times 10^{-7}$ | $6.5 \times 10^{-6}$ | $1.8 \times 10^{-7}$ |
| 123 | $3.0 \times 10^{-6}$ | $1.1 \times 10^{-6}$ | $4.0 \times 10^{-6}$ | $1.3 \times 10^{-6}$ | $5.0 \times 10^{-6}$ | $1.5 \times 10^{-7}$ | $6.5 \times 10^{-6}$ | $2.0 \times 10^{-6}$ |
| 124 | $3.0 \times 10^{-6}$ | $1.1 \times 10^{-6}$ | $4.0 \times 10^{-6}$ | $1.3 \times 10^{-6}$ | $5.0 \times 10^{-6}$ | $1.5 \times 10^{-6}$ | $6.5 \times 10^{-6}$ | $2.0 \times 10^{-6}$ |

| Sample | Red-sensitive emulsion layer | | | | Amount of hydrophilic binder ($g/m^2$) | | | | | | | |
|---|---|---|---|---|---|---|---|---|---|---|---|---|
| | large size | | small size | | | | | | | | | |
| No. | iron ion | iridium ion | iron ion | iridium ion | 1 | 2 | 3 | 4 | 5 | 6 | 7 | Total |
| 101 | $1.0 \times 10^{-6}$ | $1.0 \times 10^{-8}$ | $1.8 \times 10^{-6}$ | $2.5 \times 10^{-8}$ | 1.40 | 1.00 | 1.20 | 0.93 | 1.39 | 0.60 | 1.18 | 7.70 |
| 102 | $1.0 \times 10^{-6}$ | $1.0 \times 10^{-8}$ | $1.8 \times 10^{-6}$ | $2.5 \times 10^{-8}$ | 1.40 | 1.00 | 1.20 | 0.93 | 1.39 | 0.60 | 1.18 | 7.70 |
| 103 | $1.0 \times 10^{-6}$ | $1.0 \times 10^{-8}$ | $1.8 \times 10^{-6}$ | $2.5 \times 10^{-8}$ | 1.40 | 1.00 | 1.20 | 0.93 | 1.39 | 0.60 | 1.18 | 7.70 |
| 104 | $1.0 \times 10^{-6}$ | $1.0 \times 10^{-8}$ | $1.8 \times 10^{-6}$ | $2.5 \times 10^{-8}$ | 1.30 | 0.88 | 1.10 | 0.75 | 1.15 | 0.50 | 1.00 | 6.68 |
| 105 | $1.0 \times 10^{-6}$ | $1.0 \times 10^{-8}$ | $1.8 \times 10^{-6}$ | $2.5 \times 10^{-8}$ | 1.30 | 0.88 | 1.10 | 0.75 | 1.15 | 0.50 | 1.00 | 6.68 |
| 106 | $1.0 \times 10^{-6}$ | $1.0 \times 10^{-8}$ | $1.8 \times 10^{-6}$ | $2.5 \times 10^{-8}$ | 1.30 | 0.88 | 1.10 | 0.75 | 1.15 | 0.50 | 1.00 | 6.68 |
| 107 | $3.0 \times 10^{-6}$ | $2.3 \times 10^{-8}$ | $5.0 \times 10^{-6}$ | $5.8 \times 10^{-8}$ | 1.40 | 1.00 | 1.20 | 0.93 | 1.39 | 0.60 | 1.18 | 7.70 |
| 108 | $3.0 \times 10^{-6}$ | $2.3 \times 10^{-8}$ | $5.0 \times 10^{-6}$ | $5.8 \times 10^{-8}$ | 1.40 | 1.00 | 1.20 | 0.93 | 1.39 | 0.60 | 1.18 | 7.70 |
| 109 | $3.0 \times 10^{-6}$ | $2.3 \times 10^{-8}$ | $5.0 \times 10^{-6}$ | $5.8 \times 10^{-8}$ | 1.30 | 0.88 | 1.10 | 0.75 | 1.15 | 0.50 | 1.00 | 6.68 |
| 110 | $3.0 \times 10^{-6}$ | $2.3 \times 10^{-8}$ | $5.0 \times 10^{-6}$ | $5.8 \times 10^{-8}$ | 1.30 | 0.88 | 1.10 | 0.75 | 1.15 | 0.50 | 1.00 | 6.68 |
| 111 | $7.0 \times 10^{-6}$ | $6.5 \times 10^{-8}$ | $9.0 \times 10^{-6}$ | $8.0 \times 10^{-8}$ | 1.40 | 1.00 | 1.20 | 0.93 | 1.39 | 0.60 | 1.18 | 7.70 |
| 112 | $7.0 \times 10^{-6}$ | $6.5 \times 10^{-8}$ | $9.0 \times 10^{-6}$ | $8.0 \times 10^{-8}$ | 1.40 | 1.00 | 1.20 | 0.93 | 1.39 | 0.60 | 1.18 | 7.70 |
| 113 | $7.0 \times 10^{-6}$ | $6.5 \times 10^{-8}$ | $9.0 \times 10^{-6}$ | $8.0 \times 10^{-8}$ | 1.30 | 0.88 | 1.10 | 0.75 | 1.15 | 0.50 | 1.00 | 6.68 |
| 114 | $7.0 \times 10^{-6}$ | $6.5 \times 10^{-8}$ | $9.0 \times 10^{-6}$ | $8.0 \times 10^{-8}$ | 1.30 | 0.88 | 1.10 | 0.75 | 1.15 | 0.50 | 1.00 | 6.68 |
| 115 | $7.0 \times 10^{-6}$ | $6.5 \times 10^{-8}$ | $9.0 \times 10^{-6}$ | $8.0 \times 10^{-8}$ | 1.25 | 0.75 | 1.00 | 0.65 | 0.98 | 0.44 | 0.90 | 5.97 |
| 116 | $7.0 \times 10^{-6}$ | $6.5 \times 10^{-8}$ | $9.0 \times 10^{-6}$ | $8.0 \times 10^{-8}$ | 1.25 | 0.75 | 1.00 | 0.65 | 0.98 | 0.44 | 0.90 | 5.97 |
| 117 | $7.0 \times 10^{-6}$ | $6.5 \times 10^{-8}$ | $9.0 \times 10^{-6}$ | $8.0 \times 10^{-8}$ | 1.19 | 0.66 | 0.87 | 0.48 | 0.76 | 0.35 | 0.80 | 5.11 |
| 118 | $7.0 \times 10^{-6}$ | $6.5 \times 10^{-8}$ | $9.0 \times 10^{-6}$ | $8.0 \times 10^{-8}$ | 1.19 | 0.66 | 0.87 | 0.48 | 0.76 | 0.35 | 0.80 | 5.11 |
| 119 | $7.0 \times 10^{-6}$ | $1.5 \times 10^{-7}$ | $9.0 \times 10^{-6}$ | $2.0 \times 10^{-8}$ | 1.40 | 1.00 | 1.20 | 0.93 | 1.39 | 0.60 | 1.18 | 7.70 |
| 120 | $7.0 \times 10^{-6}$ | $1.5 \times 10^{-7}$ | $9.0 \times 10^{-6}$ | $2.0 \times 10^{-8}$ | 1.40 | 1.00 | 1.20 | 0.93 | 1.39 | 0.60 | 1.18 | 7.70 |
| 121 | $7.0 \times 10^{-6}$ | $1.5 \times 10^{-7}$ | $9.0 \times 10^{-6}$ | $2.0 \times 10^{-7}$ | 1.30 | 0.88 | 1.10 | 0.75 | 1.15 | 0.50 | 1.00 | 6.68 |
| 122 | $7.0 \times 10^{-6}$ | $1.5 \times 10^{-7}$ | $9.0 \times 10^{-6}$ | $2.0 \times 10^{-7}$ | 1.30 | 0.88 | 1.10 | 0.75 | 1.15 | 0.50 | 1.00 | 6.68 |
| 123 | $7.0 \times 10^{-6}$ | $1.1 \times 10^{-6}$ | $9.0 \times 10^{-6}$ | $1.5 \times 10^{-6}$ | 1.30 | 0.88 | 1.10 | 0.75 | 1.15 | 0.50 | 1.00 | 6.68 |
| 124 | $7.0 \times 10^{-6}$ | $1.1 \times 10^{-6}$ | $9.0 \times 10^{-6}$ | $1.5 \times 10^{-6}$ | 1.30 | 0.88 | 1.10 | 0.75 | 1.15 | 0.50 | 1.00 | 6.68 |

| Sample | Film thickness | Irradiation inhibiting dye $mg/m^2$ | | |
|---|---|---|---|---|
| No. | ($\mu$m) | I-1 | I-2 | I-3 |
| 101 | 9.5 | 4.0 | 8.0 | 40.0 |
| 102 | 9.4 | 2.2 | 4.8 | 22.0 |
| 103 | 9.5 | 1.8 | 3.8 | 12.0 |
| 104 | 8.6 | 4.0 | 8.0 | 40.0 |
| 105 | 8.7 | 2.2 | 4.8 | 22.0 |
| 106 | 8.6 | 1.8 | 3.8 | 12.0 |
| 107 | 9.5 | 4.0 | 8.0 | 40.0 |
| 108 | 9.4 | 2.2 | 4.8 | 22.0 |
| 109 | 8.7 | 4.0 | 8.0 | 40.0 |
| 110 | 8.7 | 2.2 | 4.8 | 22.0 |
| 111 | 9.5 | 2.2 | 4.8 | 22.0 |
| 112 | 9.4 | 1.8 | 3.8 | 12.0 |

TABLE 3-continued

| | | | | |
|---|---|---|---|---|
| 113 | 8.7 | 2.2 | 4.8 | 22.0 |
| 114 | 8.7 | 1.8 | 3.8 | 12.0 |
| 115 | 7.9 | 2.2 | 4.8 | 22.0 |
| 116 | 7.9 | 1.8 | 3.8 | 12.0 |
| 117 | 7.0 | 2.2 | 4.8 | 22.0 |
| 118 | 7.0 | 1.8 | 3.8 | 12.0 |
| 119 | 9.5 | 2.2 | 4.8 | 22.0 |
| 120 | 9.5 | 1.8 | 3.8 | 12.0 |
| 121 | 8.7 | 2.2 | 4.8 | 22.0 |
| 122 | 8.7 | 1.8 | 3.8 | 12.0 |
| 123 | 8.6 | 2.2 | 4.8 | 22.0 |
| 124 | 8.7 | 1.8 | 3.8 | 12.0 |

The film thickness was the difference of the measured thickness of the support before the coating of photographic constitutional layers and that after the coating of photographic constitutional layers.

To the Sample (101), the following exposure to light and processing were carried out. The sample 101 was subjected to gradation exposure to light for sensitometry through a red filter, using a sensitometer (FWH type, manufactured by Fuji Photo Film Co., Ltd.; color temperature of the light source: 3,200° K). This exposure was carried out such that the exposure amount would be 250 CMS by the exposure time of 1 sec. Then, the sample was processed as follows.

| Processing step | Temperature | Time | Replenishment rate* |
|---|---|---|---|
| Color development | 38.5° C. | 45 sec | 45 ml |
| Bleach-fix | 38.0° C. | 45 sec | 35 ml |
| Rinse (1) | 38.0° C. | 15 sec | — |
| Rinse (2) | 38.0° C. | 15 sec | — |
| Rinse (3) | **38.0° C. | 15 sec | — |
| Rinse (4) | **38.0° C. | 20 sec | 121 ml |

*Replenishment rates were amounts per $m^2$ of the light-sensitive material processed.
**A Rinse Cleaning system RC50D, trade name, manufactured by Fuji Photo Film Co., Ltd., was installed in a rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation was conducted for 10 hours per day, with the temperature controlled.
(The rinse was of a tank counter-current system from the tank (1) to the tank (4).)

The compositions of the processing solutions were as follows.

[Color Developer]

| | Tank Solution | Replenisher |
|---|---|---|
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (MW 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF, trade name: manufactured by Showa Kagaku Co.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-aminoaniline 3/2 sulfuric acid monohydrate | 5.0 g | 15.7 g |
| Potassium carbonate | 26.3 g | 26.3 g |
| Water to make | 1000 ml | 1000 ml |
| pH (adjusted by using potassium hydroxide and sulfuric acid at 25° C.) | 10.15 | 12.50 |
| [Breach-Fixing Solution] | | |
| Water | 700 ml | 600 ml |
| Ethylenediaminetetraacetate iron (III) ammonium | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/litter) | 107.0 ml | 214.0 ml |
| Ammonium sulfite | 16.0 g | 32.0 g |
| Potassium bisulfite | 23.1 g | 46.2 g |
| Water to make | 1000 ml | 1000 ml |
| pH (adjusted by using acetic acid and ammonia at 25° C.) | 6.0 | 6.0 |
| [Rinse Solution] | | |
| Sodium chlorinated-isocyanurate | 0.02 g | 0.02 g |
| Deionized water (having a conductivity of 5 μs/cm or below) | 1000 ml | 1000 ml |
| pH | 6.5 | 6.5 |

A sensitometric curve corresponding to the cyan-colored layer was obtained by measuring the color density of the processed sample (101). Using the thus-obtained sensitometric curve, the exposure amount ($E_1$) needed to give the color density of a density at the unexposed portion (Dmin)+1.8, and the exposure amount ($E_2$) needed to give the color density of Dmin+0.02, were measured. In order to evaluate gradation, the value of log ($E_1/E_2$) was obtained by calculation. This value indicates that contrast is higher with a smaller value, whereas it is lower with a larger value. Sensitometric curves corresponding to a yellow-colored layer and a magenta-colored layer were respectively obtained in the same manner as in the above, except that the red filter used for exposure was replaced by a blue filter or a green filter. Using these sensitometric curves, the value of log ($E_1/E_2$) was also obtained with respective to each of the yellow-colored layer and the magenta-colored layer.

Sensitometric curves corresponding to each of the cyan-, magenta-, and yellow-colored layers were obtained in the same manner as in the above, except for changing the exposure time from 1 second to $10^{-4}$ second. Using the thus-obtained sensitometric curves, the exposure amount ($E'_1$) needed to give the color density of Dmin+1.8, and the exposure time ($E'_2$) needed to give the color density of Dmin+0.02, were measured. In order to evaluate gradation, the value of log ($E'_1/E'_2$) was obtained by calculation. This value indicates that contrast is higher with a smaller value, whereas it is lower with a larger value. In order to evaluate the difference in gradation between low-intensity, long-time exposure (1 second) and high-illumination-intensity, short-time exposure ($10^{-4}$ second), the value of log ($E'_1/E'_2$)−log ($E_1/E_2$) was obtained. This value indicates that when it is closer to 0, there is less difference in gradation between long-time exposure and short-time exposure.

In order to evaluate sharpness, an optical wedge having rectangular patterns of various frequencies was placed in close contact with a sample, and they were exposed to light (1-second exposure), followed by the above-described processing. The exposure was carried out using red, blue, and green filters, whose densities were adjusted so that the obtained color density would be Dmin+1.5 at a gray portion. As an indicator of sharpness, CTF values were measured. The CTF value is the ratio of $\Delta D_3/\Delta D_0$, in which $\Delta D_0$ represents for a difference in density between the gray density at the exposed portion and the density at the unexposed portion, at a frequency of 0 (zero), i.e., with no repetition of rectangular patterns, and the exposed portion and the unexposed portion were continuously exposed over a very wide area; and $\Delta D_3$ represents a difference in density having the same meanings as the above, except that the exposure was carried out at three frequencies of rectangular pattern per mn of width. This ratio of $\Delta D_3/\Delta D_0$ indicates that when it is closer to 1, sharpness is better, whereas when it is closer to 0, sharpness is worse.

The laser light sources used were a blue light of 473 nm, a green light of 532 nm, and a red light of 680 nm. The three laser rays, each having a different wavelength, as mentioned above, were modulated to vary the quantity of light from each ray, using an external modulator, so that the color density that should have been obtained by a processing could be Dmin+1.5 at gray portion. Allowing these laser rays to be reflected on a mirror of a rotary polyhedron, scanning exposure was effected at 300 dpi, and it was carried out by successively applying the laser rays to a sample, which was moved in the direction vertical to the scanning direction. The exposure time was $3\times10^{-7}$ seconds per one pixel. The same rectangular pattern exposure as above was carried out by varying the quantity of light by means of an external modulator, followed by the same processing as above, whereby the value of CTF ($\Delta D_3/\Delta D_0$) in the scanning exposure was obtained.

Unexposed samples were subjected to the above-described processing. Further, the processed samples were subjected to a gray reflection densitometric measurement, using an X-Rite 310, trade name, manufactured by X-Rite Company, to obtain a density value at the unexposed portion. These samples were further washed for 1 hour in running water at 35° C., followed by drying. Thereafter, these samples were again subjected to the same reflection densitometric measurement. The value obtained by subtracting the density value after the additional washing, from the density value before the additional washing, was calculated, as an indicator of remaining color. This value indicates that the smaller the value is, the less remaining color there is.

The evaluation results are shown in Table 4.

TABLE 4

| Sample | 1-second exposure log ($E_1/E_2$) | | | $10^{-4}$-second exposure log ($E'_1/E'_2$) | | | log ($E'_1/E'_2$) − log ($E_1/E_2$) | | | Max optical density of row | Residual |
|---|---|---|---|---|---|---|---|---|---|---|---|
| No. | Yellow | Magenta | Cyan | Yellow | Magenta | Cyan | Yellow | Magenta | Cyan | sample** | color |
| 101 | 0.85 | 0.91 | 0.90 | 1.32 | 1.38 | 1.31 | 0.49 | 0.47 | 0.41 | 0.90 | 0.081 |
| 102 | 0.88 | 0.90 | 0.92 | 1.30 | 1.30 | 1.30 | 0.42 | 0.40 | 0.38 | 0.65 | 0.065 |
| 103 | 0.88 | 0.88 | 0.92 | 1.33 | 1.35 | 1.33 | 0.45 | 0.47 | 0.45 | 0.35 | 0.027 |
| 104 | 0.86 | 0.90 | 0.93 | 1.30 | 1.36 | 1.31 | 0.44 | 0.46 | 0.38 | 0.91 | 0.070 |
| 105 | 0.85 | 0.89 | 0.91 | 1.35 | 1.33 | 1.30 | 0.50 | 0.44 | 0.39 | 0.64 | 0.030 |
| 106 | 0.85 | 0.89 | 0.93 | 1.30 | 1.33 | 1.30 | 0.45 | 0.44 | 0.37 | 0.35 | 0.018 |
| 107 | 0.90 | 0.93 | 0.98 | 1.08 | 1.10 | 1.13 | 0.18 | 0.17 | 0.15 | 0.90 | 0.079 |
| 108 | 0.91 | 0.95 | 0.99 | 1.08 | 1.13 | 1.13 | 0.17 | 0.18 | 0.14 | 0.65 | 0.067 |
| 109 | 0.89 | 0.95 | 0.97 | 1.02 | 1.11 | 1.17 | 0.13 | 0.16 | 0.20 | 0.91 | 0.069 |
| 110 | 0.89 | 0.94 | 0.99 | 1.08 | 1.11 | 1.14 | 0.19 | 0.15 | 0.15 | 0.65 | 0.029 |
| 111 | 1.01 | 0.98 | 0.97 | 0.99 | 1.03 | 1.05 | −0.02 | −0.05 | 0.08 | 0.65 | 0.067 |
| 112 | 1.01 | 1.00 | 0.95 | 0.98 | 1.01 | 1.04 | −0.03 | 0.01 | 0.09 | 0.35 | 0.025 |
| 113 | 0.97 | 0.98 | 0.95 | 0.99 | 1.03 | 1.04 | 0.02 | 0.05 | 0.09 | 0.66 | 0.029 |
| 114 | 0.99 | 0.98 | 0.98 | 1.01 | 1.03 | 1.02 | 0.02 | 0.05 | 0.04 | 0.36 | 0.019 |
| 115 | 0.99 | 0.96 | 0.97 | 1.02 | 1.00 | 1.02 | 0.03 | 0.04 | 0.03 | 0.64 | 0.018 |
| 116 | 1.01 | 0.99 | 0.96 | 0.98 | 1.01 | 1.02 | −0.03 | 0.02 | 0.06 | 0.36 | 0.010 |
| 117 | 1.01 | 1.00 | 0.97 | 0.99 | 1.01 | 1.04 | 0.02 | 0.01 | 0.04 | 0.65 | 0.011 |
| 118 | 1.01 | 0.99 | 0.96 | 0.99 | 0.98 | 1.04 | 0.02 | −0.01 | 0.02 | 0.35 | 0.009 |
| 119 | 1.03 | 1.05 | 1.07 | 0.84 | 0.87 | 0.89 | −0.19 | −0.18 | −0.18 | 0.65 | 0.063 |
| 120 | 1.01 | 1.04 | 1.06 | 0.83 | 0.88 | 0.90 | −0.18 | −0.16 | −0.14 | 0.35 | 0.028 |
| 121 | 1.01 | 1.07 | 1.05 | 0.85 | 0.88 | 0.88 | −0.16 | −0.19 | −0.17 | 0.66 | 0.025 |
| 122 | 1.01 | 1.07 | 1.05 | 0.86 | 0.87 | 0.90 | −0.15 | −0.20 | −0.15 | 0.37 | 0.016 |
| 123 | 1.39 | 1.43 | 1.37 | 0.63 | 0.60 | 0.62 | −0.76 | −0.83 | −0.75 | 0.67 | 0.026 |
| 124 | 1.41 | 1.48 | 1.36 | 0.64 | 0.62 | 0.64 | −0.76 | −0.86 | −0.72 | 0.35 | 0.017 |

TABLE 4-continued

| Sample No. | Sharpness ($\Delta D_3/\Delta D_0$) 1-second exposure | Scanning exposure | Remarks |
|---|---|---|---|
| 101 | 0.85 | 0.75 | Comparative example |
| 102 | 0.57 | 0.37 | Comparative example |
| 103 | 0.43 | 0.31 | Comparative example |
| 104 | 0.87 | 0.83 | Comparative example |
| 105 | 0.59 | 0.40 | Comparative example |
| 106 | 0.48 | 0.34 | Comparative example |
| 107 | 0.86 | 0.85 | Comparative example |
| 108 | 0.65 | 0.51 | Comparative example |
| 109 | 0.88 | 0.88 | Comparative example |
| 110 | 0.74 | 0.79 | This invention |
| 111 | 0.83 | 0.57 | Comparative example |
| 112 | 0.71 | 0.49 | Comparative example |
| 113 | 0.84 | 0.88 | This invention |
| 114 | 0.79 | 0.75 | This invention |
| 115 | 0.88 | 0.94 | This invention |
| 116 | 0.79 | 0.81 | This invention |
| 117 | 0.90 | 0.95 | This invention |
| 118 | 0.84 | 0.85 | This invention |
| 119 | 0.77 | 0.60 | Comparative example |
| 120 | 0.60 | 0.53 | Comparative example |
| 121 | 0.85 | 0.89 | This invention |
| 122 | 0.79 | 0.74 | This invention |
| 123 | 0.40 | 0.90* | Comparative example |
| 124 | 0.34 | 0.75* | Comparative example |

*In samples 123 and 124, when they were subjected to a color-developing processing after the scanning exposure, disappearance of color occurred.

**Maximum optical density of a sample not subjected to exposure to light or processed. Using a support free from a coating of photographic constitutional layers as a reference, unexposed and unprocessed samples were subjected to reflection densitometric measurement in the wavelength region of 400 nm to 800 nm, to obtain the maximum optical density in this wavelength region.

Samples 101, 104, 107, and 109 were designed so that the coating amount of the anti-irradiation dye would be large, to improve sharpness. However, the results in Table 4 show that much color remained in these samples when they were subjected to a rapid processing. In samples 102, 103, 105, 106, 108, 111, 112, 119, and 120, wherein the coating amount of the anti-irradiation dye was reduced in order to prevent remaining color, indeed the remaining color was less. However, in these samples sharpness upon a scanning exposure in particular deteriorated, so that both properties of remaining color and sharpness could not be satisfied at the same time.

As is apparent from the results of samples 110, 113 to 118, 121, and 122, it is understood that, with respect to these samples, whose coating amount of the anti-irradiation dye was less, sharpness could be improved by adjusting the gradation of both a 1-second exposure and a $10^{-4}$-second exposure as defined in the present invention, and also by reducing the amount of a binder. The improvement in sharpness is outstanding upon a scanning exposure rather than a 1-second exposure, which was beyond expectation.

As is apparent from the results of samples 123 and 124, the value of gradation upon a $10^{-4}$-second exposure was further reduced, in order to further improve sharpness upon a scanning exposure. Namely, if a hard gradation enhancement is made over the limitation defined by the present invention, the appearance of color of an image obtained by a scanning exposure becomes as clear as can be appreciated with the naked eye. In addition, at the same time, a gradation upon a 1-second exposure becomes soft over the limitation defined by the present invention, which results in deterioration of sharpness upon a 1-second exposure. Therefore, it is apparent that only the ranges as defined in the present invention satisfy photographic properties of both remaining color and sharpness in both exposure systems of a usual printer exposure and a scanning exposure.

Further, additional samples, each having a reflection spectrum similar to that in Example 1, were prepared by using I-4 in place of I-1, by using I-5 or I-6 in place of I-2, and/or by using I-7 or I-8 in place of I3, and further by altering each amount of these anti-irradiation dyes. As a result, effects equivalent to those shown in Table 4 were obtained.

I-4

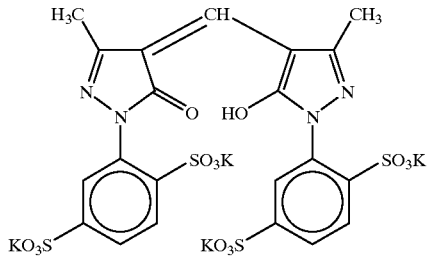

I-5

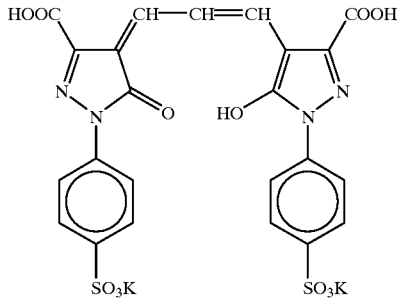

-continued

I-6

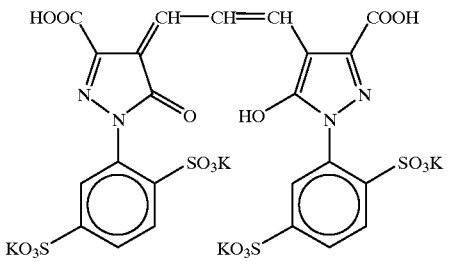

I-7

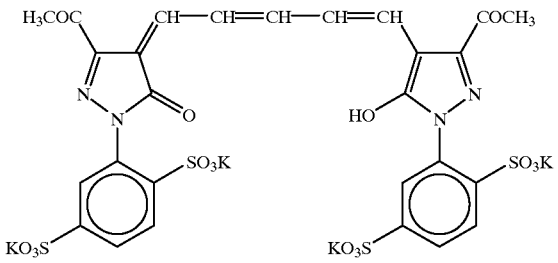

I-8

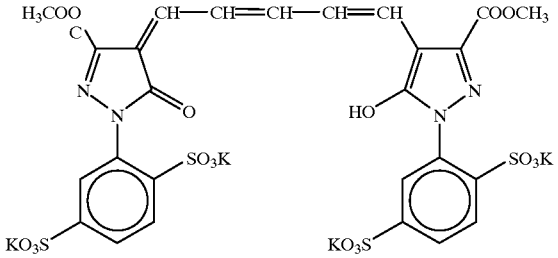

Example 2

The following emulsions B1 to B6, each containing blue light-sensitive tabular silver chlorobromide grains having (100) planes as major planes, were prepared.

B1: average aspect ratio, 3.3; equivalent-circle diameter (the average diameter of a circle which is equivalent to the projected area of an individual grain) of the major face, 0.97 μm; coefficient of variation of the grain size, 0.14

B2: average aspect ratio, 4.8; equivalent-circle diameter of the major face, 1.10 μm; coefficient of variation of the grain size, 0.14

B3: average aspect ratio, 7.3; equivalent-circle diameter of the major face, 1.27 μm; coefficient of variation of the grain size, 0.16

B4: average aspect ratio, 3.1; equivalent-circle diameter of the major face, 0.81 μm; coefficient of variation of the grain size, 0.16

B5: average aspect ratio, 4.5; equivalent-circle diameter of the major face, 0.93 μm; coefficient of variation of the grain size, 0.16

B6: average aspect ratio, 7.1; equivalent-circle diameter of the major face, 1.08 μm; coefficient of variation of the grain size, 0.16

The contents of additives based on 1 mol of silver, such as sensitizing dyes, metal ions, and silver bromide in the emulsions B1 to B3, were the same as those in the large-size emulsion in the yellow coupler-containing blue light-sensitive layer of the sample (114), with the proviso that there was a difference in the grain shape between them.

The contents of additives based on 1 mol of silver, such as sensitizing dyes, metal ions, and silver bromide in the emulsions B4 to B6, were the same as those in the small-size emulsion in the yellow coupler-containing blue light-sensitive layer of the sample (114), with the proviso that there was a difference in the grain shape between them.

Samples (201) and (202) were each prepared in the same manner as samples (114) and (116), except that the fifth layer (cyan coupler-containing red light-sensitive emulsion layer) was replaced by the first layer, and the first layer (yellow coupler-containing blue light-sensitive emulsion layer) was replaced by the fifth layer, respectively.

Sample (203) was prepared in the same manner as sample (114), except that the large-size emulsion and the small-size emulsion in the yellow coupler-containing blue light-sensitive layer were replaced by the emulsions B3 and B6, respectively. Similarly, based on sample (201), the large-size emulsion and the small-size emulsion in the yellow coupler-containing blue light-sensitive layer thereof, were each replaced by the emulsions B1 and B4, the emulsions B2 and B5, and the emulsions B3 and B6, to prepare samples (204), (205), and (206), respectively. Further, based on sample (202), the large-size emulsion and the small-size emulsion in the yellow coupler-containing blue light-sensitive layer thereof, were replaced by the emulsion B3 and B6, to prepare sample (207).

TABLE 5

| | Emulsion in yellow coupler-containing blue light-sensitive layer | | Order of coating for coupler-containing layers |
|---|---|---|---|
| Sample No. | Large-size emulsion | Small-size emulsion | (from support to uppermost layer) |
| 114 | cube | cube | Yellow, Magenta, Cyan |
| 116 | // | // | Yellow, Magenta, Cyan |
| 201 | // | // | Cyan, Magenta, Yellow |
| 202 | // | // | Cyan, Magenta, Yellow |
| 203 | tabular, aspect ratio 7.3 | tabular, aspect ratio 7.1 | Yellow, Magenta, Cyan |
| 204 | tabular, aspect ratio 3.3 | tabular, aspect ratio 3.1 | Cyan, Magenta, Yellow |
| 205 | tabular, aspect ratio 4.8 | tabular, aspect ratio 4.5 | Cyan, Magenta, Yellow |
| 206 | tabular, aspect ratio 7.3 | tabular, aspect ratio 7.1 | Cyan, Magenta, Yellow |
| 207 | tabular, aspect ratio 7.3 | tabular, aspect ratio 7.1 | Cyan, Magenta, Yellow |

The same evaluations as in Example 1 were carried out, with respect to Samples (114), (116), and (201) to (207).

TABLE 6

| Sample | 1-second exposure log ($E_1/E_2$) | | | $10^{-4}$-seconds exposure log ($E'_1/E'_2$) | | | log ($E'_1/E'_2$) − log ($E_1/E_2$) | | | Amount of hydrophilic binder g/m$^2$ (film |
|---|---|---|---|---|---|---|---|---|---|---|
| No. | Yellow | Magenta | Cyan | Yellow | Magenta | Cyan | Yellow | Magenta | Cyan | thickness/$\mu$m) |
| 114 | 0.98 | 0.99 | 0.96 | 1.03 | 1.01 | 1.01 | 0.05 | 0.02 | 0.05 | 6.68(8.7) |
| 116 | 1.00 | 0.98 | 0.96 | 1.03 | 1.03 | 1.00 | 0.03 | 0.05 | 0.04 | 5.97(7.9) |
| 201 | 0.95 | 0.99 | 0.99 | 0.97 | 1.01 | 1.01 | 0.02 | 0.02 | 0.02 | 6.68(8.7) |
| 202 | 0.94 | 0.98 | 0.97 | 0.95 | 1.03 | 1.03 | 0.01 | 0.06 | 0.06 | 5.97(7.9) |
| 203 | 0.97 | 0.98 | 0.98 | 1.00 | 0.99 | 1.00 | 0.03 | 0.01 | 0.02 | 6.68(8.7) |
| 204 | 0.95 | 0.99 | 0.99 | 0.99 | 1.02 | 1.03 | 0.04 | 0.03 | 0.04 | 6.68(8.7) |
| 205 | 0.93 | 1.01 | 1.00 | 0.97 | 1.04 | 1.05 | 0.04 | 0.03 | 0.05 | 6.68(8.7) |
| 206 | 0.90 | 0.99 | 1.00 | 0.92 | 1.03 | 1.05 | 0.02 | 0.04 | 0.05 | 6.68(8.7) |
| 207 | 0.92 | 0.99 | 0.99 | D.93 | 1 03 | 1 05 | 0.03 | 0.04 | 0.06 | 5.97(7.9) |

| Sample No. | Max optical density of row sample* | Residual color | Sharpness ($\Delta D_3/\Delta D_0$) 1-second exposure | Scanning exposure | Remarks |
|---|---|---|---|---|---|
| 114 | 0.36 | 0.019 | 0.79 | 0.75 | This invention |
| 116 | 0.35 | 0.011 | 0.79 | 0.81 | This invention |
| 201 | 0.36 | 0.015 | 0.81 − | 0.83 | This invention |
| 202 | 0.36 | 0.008 | 0.81 | 0.86 | This invention |
| 203 | 0.37 | 0.018 | 0.80 | 0.85 | This invention |
| 204 | 0.36 | 0.012 | 0.81 | 0.83 | This invention |
| 205 | 0.36 | 0.012 | 0.83 | 0.91 | This invention |
| 206 | 0.36 | 0.012 | 0.84 | 0.94 | This invention |
| 207 | 0.36 | 0.006 | 0.85 | 0.96 | This invention |

*Maximum optical density of unexposed and unprocessed sample

The results shown in Table 6 demonstrate that sharpness upon a scanning exposure could be specifically improved by placing a yellow coupler-containing layer at the side further from a support than a magenta coupler-containing layer or a cyan coupler-containing layer, and/or by using a tabular emulsion having an aspect ratio of 4 or more, as a silver halide emulsion in the yellow coupler-containing layer.

Example 3

Samples (301) to (304) were prepared in the same manner as samples (103), (114), (116), and (207), except that the amount of anti-irradiation dye I-3 therein was changed to 6.0 mg/m$^2$, and in addition 6.0 mg/m$^2$ of D-22 was newly contained therein, respectively. These samples were subjected to the same evaluation as in Example 2. Further, the following exposure was carried out, to evaluate the change in color density due to a safe light. Namely, prior to a gradation exposure, a sample was uniformly exposed to a 10-W tungsten light from a distance of 1 m for 15 minutes through safe light glass SLG-103A, trade name, manufactured by Fuji Photo Film Co. Ltd. Thereafter, a gradation exposure (a 1-second exposure) was carried out through a red filter using the above-described FWH model sensitometer, followed by the same processing as the above, to obtain a sensitometric curve corresponding to the cyan-colored layer. On the other hand, using a sensitometric curve, which was obtained by an exposure without the safe light glass SLG-103A, an exposure amount ($E_1$) needed to obtain a color density of Dmin+0.02 was measured. Accordingly, the change in color density was measured by a previous exposure through the safe light glass SLG-103A in the above-mentioned exposure amount ($E_1$).

This value indicates that the smaller the change in the color density is, the smaller the change in photographic properties due to an irradiation by a safe light is.

TABLE 7

| Sample No. | 1-second exposure Yellow | Magenta | Cyan | $10^{-4}$-seconds exposure Yellow | Magenta | Cyan | log ($E'_1/E'_2$) − log ($E_1/E_2$) Yellow | Magenta | Cyan | Amount of hydrophilic binder g/m$^2$ (film thickness/ μm) | Max optical density of row sample* (optical density at 600 nm) |
|---|---|---|---|---|---|---|---|---|---|---|---|
| 103 | 0.89 | 0.86 | 0.91 | 1.32 | 1.31 | 1.31 | 0.43 | 0.45 | 0.40 | 7.70(9.5) | 0.35(0.10) |
| 114 | 1.01 | 0.99 | 0.99 | 1.03 | 1.00 | 1.02 | 0.02 | 0.01 | 0.03 | 6.68(8.7) | 0.36(0.10) |
| 116 | 1.00 | 1.01 | 1.02 | 0.99 | 0.99 | 1.03 | −0.01 | −0.02 | 0.01 | 5.97(7.9) | 0.35(0.10) |
| 207 | 0.92 | 1.00 | 0.99 | 0.93 | 1.01 | 0.98 | −0.01 | 0.01 | −0.01 | 5.97(7.9) | 0.36(0.10) |
| 301 | 0.90 | 0.87 | 0.90 | 1.33 | 1.31 | 1.31 | 0.43 | 0.44 | 0.41 | 7.70(9.6) | 0.35(0.09) |
| 302 | 1.00 | 0.96 | 0.98 | 1.01 | 0.99 | 1.01 | 0.01 | 0.03 | 0.03 | 6.68(8.7) | 0.35(0.10) |
| 303 | 1.01 | 0.99 | 0.96 | 1.04 | 1.01 | 0.99 | 0.03 | 0.02 | 0.03 | 5.97(7.9) | 0.36(0.09) |
| 304 | 0.91 | 1.01 | 1.00 | 0.94 | 1.03 | 0.97 | 0.03 | 0.02 | −0.03 | 5.97(7.9) | 0.36(0.09) |

| Sample No. | Residual color | Sharpness ($\Delta D_3/\Delta D_0$) 1-second exposure | Scanning exposure | Change of color density due to safe light irradiation | Remarks |
|---|---|---|---|---|---|
| 103 | 0.028 | 0.45 | 0.33 | 0.02 | Comparative example |
| 114 | 0.018 | 0.80 | 0.76 | 0.05 | This invention |
| 116 | 0.011 | 0.80 | 0.81 | 0.08 | This invention |
| 207 | 0.007 | 0.85 | 0.96 | 0.06 | This invention |
| 301 | 0.026 | 0.46 | 0.33 | 0.01 | Comparative example |
| 302 | 0.017 | 0.79 | 0.77 | 0.02 | This invention |
| 303 | 0.010 | 0.79 | 0.82 | 0.03 | This invention |
| 304 | 0.006 | 0.85 | 0.96 | 0.02 | This invention |

*Maximum optical density of unexposed and unprocessed sample (optical density at 600 nm)

The results shown in Table 7 demonstrate that samples (301) to (304), each of which used the anti-irradiation dye D-22, also exhibited the maximum optical density of the unexposed and unprocessed sample and the gradation upon a 1-second exposure and a $10^{-4}$ second exposure, each of which was the same as those of other samples (103), (114), (116), and (207), respectively, and that as a matter of course, both sharpness and remaining color of samples (301) to (304) were also almost the same as those of the other samples. Further, it can be seen from Table 7 that, in samples (114), (116), and (207), each of which was improved in remaining color and sharpness in comparison with sample (103), the change in color density owing to a safe light became larger. It can also be seen from Table 7 that, in samples (302) to (304), each containing the anti-irradiation dye D-22, the change in color density caused by a safe light could be remarkably restrained with no deterioration of both sharpness and remaining color. The safe light is a light that has a maximum absorption wavelength in the neighborhood of 600 nm. However, even though D-22 was used, the absorption rate of a light in the neighborhood of 600 nm owing to the anti-irradiation dye did not change. This result was beyond expectation.

Example 4

The same evaluations as in Examples 1 to 3 were carried out, except for changing the processings carried out in Examples 1 to 3 to the processing shown below. As a result, the similar effects (results) as in Examples 1 to 3 were obtained.

| Processing step | Temperature | Time | Replenishment rate* |
|---|---|---|---|
| Color development | 45.0° C. | 12 sec | 45 ml |
| Bleach-fix | 40.0° C. | 12 sec | 35 ml |
| Rinse (1) | 40.0° C. | 4 sec | — |
| Rinse (2) | 40.0° C. | 4 sec | — |
| Rinse (3) | **40.0° C. | 4 sec | — |
| Rinse (4) | **40.0° C. | 4 sec | 121 ml |

*Replenishment rates were amounts per m$^2$ of the light-sensitive material processed.

**A Rinse Cleaning system RC50D, trade name, manufactured by Fuji Photo Film Co., Ltd., was installed in a rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation was conducted for 10 hours per day, with the temperature controlled.

(The rinse was of a tank counter-current system from the tank (1) to the tank (4).)

The compositions of the processing solutions were as follows.

[Color Developer]

| | Tank Solution | Reple-nisher |
|---|---|---|
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (MW 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF, trade name: manufactured by Showa Kagaku Co.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-aminoaniline 3/2 sulfuric acid monohydrate | 10.0 g | 22.0 g |
| Potassium carbonate | 26.3 g | 26.3 g |
| Water to make | 1000 ml | 1000 ml |
| pH (adjusted by using potassium hydroxide and sulfuric acid at 25° C.) | 10.15 | 12.50 |
| [Breach-Fixing Solution] | | |
| Water | 700 ml | 600 ml |
| Ethylenediaminetetraacetate iron (III) ammonium | 75.0 g | 150.0 g |
| Ethylenediaminetetraacetic acid | 1.4 g | 2.8 g |
| m-Carboxymethylbenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/litter) | 107.0 ml | 214.0 ml |
| Ammonium sulfite | 16.0 g | 32.0 g |
| Potassium metabisulfite | 23.1 g | 46.2 g |
| Water to make | 1000 ml | 1000 ml |
| pH (adjusted by using acetic acid and ammonia at 25° C.) | 5.5 | 5.5 |
| [Rinse Solution] | | |
| Sodium chlorinated-isocyanurate | 0.02 g | 0.02 g |
| Deionized water (having a conductivity of 5 μs/cm or below) | 1000 ml | 1000 ml |
| pH | 6.5 | 6.5 |

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide color photographic light-sensitive material having, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, wherein at least one layer of the silver halide emulsion layers contains light-sensitive silver halide grains which have a silver chloride content of 95 mol % or more and which contain a metal ion belonging to group VIII of the periodic table, wherein the total amount of a hydrophilic binder in photographic constitutional layers of the light-sensitive material is 6.7 g/m$^2$ or less, wherein the maximum optical density in the visible region of 400 nm to 800 nm of the light-sensitive material is from 0.2 to 0.7, and wherein the following relations are established with each of the characteristic curves of yellow, magenta, and cyan images, which images are obtained by subjecting the light-sensitive material to exposure and then a color processing:

$$0.7 \leqq \log (E_1/E_2) \leqq 1.3, \text{ and}$$

$$0.7 \leqq \log (E'_1/E'_2) \leqq 1.3, \text{ and}$$

$$-0.2 \leqq \log (E'_1/E'_2) - \log (E_1/E_2) \leqq 0.2$$

in which $E_1$ represents an exposure amount necessary to obtain a color density of Dmin+1.8 in each of the characteristic curves of yellow-, magenta-, and cyan-colored images obtained by a 1-second exposure followed by a color processing;

$E_2$ represents an exposure amount necessary to obtain a color density of Dmin+0.02 in each of the characteristic curves of yellow-, magenta-, and cyan-colored images obtained by a 1-second exposure followed by a color processing;

$E'_1$ represents an exposure amount necessary to obtain a color density of Dmin+1.8 in each of the characteristic curves of yellow-, magenta-, and cyan-colored images obtained by a $10^{-4}$-second exposure followed by a color processing;

$E'_2$ represents an exposure amount necessary to obtain a color density of Dmin+0.02 in each of the characteristic curves of yellow-, magenta-, and cyan-colored images obtained by a $10^{-4}$-second exposure followed by a color processing; and Dmin represents a density obtained by subjecting an unexposed light-sensitive material to a color processing.

2. The silver halide color photographic light-sensitive material as claimed in claim 1, wherein the total amount of a hydrophilic binder of the photographic constitutional layers is 6.0 g/m$^2$ or less, and the film thickness of the photographic constitutional layers is 8.0 μm or less.

3. The silver halide color photographic light-sensitive material as claimed in claim 1, wherein the silver halide emulsion layer containing a yellow dye-forming coupler is positioned more remote from the support in comparison with the silver halide emulsion layer containing a magenta dye-forming coupler or the silver halide emulsion layer containing a cyan dye-forming coupler.

4. The silver halide color photographic light-sensitive material as claimed in claim 1, further comprising an anti-irradiation dye represented by the following formula (I):

Formula (I)

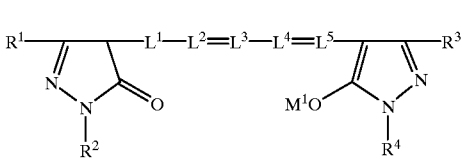

wherein $R^1$ and $R^3$ each represent an electron-withdrawing group having a Hammett's substituent constant op value of 0.3 or more; $R^2$ and $R^4$ each represent an alkyl group or an aryl group; $L^1$, $L^2$, $L^3$, $L^4$, and $L^5$ each represent a methine group; $M^1$ represents a hydrogen atom, or an atomic group or metal ion that forms a monovalent cation, with the proviso that at least one of $L^1$ to $L^5$ has a substituent.

5. The silver halide color photographic light-sensitive material as claimed in claim 1, wherein at least a half of silver halide grains, in terms of the silver amount, comprises tabular high-silver-chloride silver halide grains having an average aspect ratio of 4 or more and a silver chloride content of 95 mol % or more, in the silver halide emulsion of the light-sensitive layer containing a yellow dye-forming coupler.

6. The silver halide color photographic light-sensitive material as claimed in claim 1, wherein the light-sensitive silver halide grains contain at least one gold sensitizer.

7. The silver halide color photographic light-sensitive material as claimed in claim 1, wherein a weight ratio of amounts of oil-soluble materials to that of hydrophilic binder in the photographic constitutional layers other than protective layers is 0.05 to 1.50.

8. The silver halide color photographic light-sensitive material as claimed in claim 1, wherein the metal ion of group VIII of the periodic table is an ion of a metal selected from the group consisting of iron, cobalt, nickel, ruthenium, rhodium, iridium, and platinum.

9. A method of forming a color image, which comprises processing a silver halide color photographic light-sensitive material at a color developing time of 20 seconds or less, wherein the silver halide color photographic light-sensitive material has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, wherein at least one layer of the silver halide emulsion layers contains light-sensitive silver halide grains which have a silver chloride content of 95 mol % or more and which contain a metal ion belonging to group VIII of the periodic table, wherein the total amount of a hydrophilic binder in photographic constitutional layers of the light-sensitive material is 6.7 $g/m^2$ or less, wherein the maximum optical density in the visible region of 400 nm to 800 nm of the light-sensitive material is from 0.2 to 0.7, and wherein the following relations are established with each of the characteristic curves of yellow, magenta, and cyan images, which images are obtained by subjecting the light-sensitive material to exposure and then a color processing:

$$0.7 \leqq \log (E_1/E_2) \leqq 1.3, \text{ and}$$

$$0.7 \leqq \log (E'_1/E'_2) \leqq 1.3, \text{ and}$$

$$-0.2 \leqq \log (E'_1/E'_2) - \log (E_1/E_2) \leqq 0.2$$

in which $E_1$ represents an exposure amount necessary to obtain a color density of Dmin+1.8 in each of the characteristic curves of yellow-, magenta-, and cyan-colored images obtained by a 1-second exposure followed by a color processing;

$E_2$ represents an exposure amount necessary to obtain a color density of Dmin+0.02 in each of the characteristic curves of yellow-, magenta-, and cyan-colored images obtained by a 1-second exposure followed by a color processing;

$E'_1$ represents an exposure amount necessary to obtain a color density of Dmin+1.8 in each of the characteristic curves of yellow-, magenta-, and cyan-colored images obtained by a $10^{-4}$-second exposure followed by a color processing;

$E'_2$ represents an exposure amount necessary to obtain a color density of Dmin+0.02 in each of the characteristic curves of yellow-, magenta-, and cyan-colored images obtained by a $10^{-4}$-second exposure followed by a color processing; and Dmin represents a density obtained by subjecting an unexposed light-sensitive material to a color processing.

10. The method of forming a color image as claimed in claim 9, wherein the light-sensitive material is processed at a color developing time of 20 seconds or less, a bleach-fixing time of 20 seconds or less, and a water-washing or stabilizing time of 30 seconds or less.

11. A method of forming a color image, which comprises subjecting a silver halide color photographic light-sensitive material to a scanning exposure at an exposure time of $10^{-4}$ seconds or less, and subjecting the resultant light-sensitive material to development processing, wherein the silver halide color photographic light-sensitive material has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, wherein at least one layer of the silver halide emulsion layers contains light-sensitive silver halide grains which have a silver chloride content of 95 mol % or more and which contain a metal ion belonging to group VIII of the periodic table, wherein the total amount of a hydrophilic binder in photographic constitutional layers of the light-sensitive material is 6.7 $g/m^2$ or less, wherein the maximum optical density in the visible region of 400 nm to 800 nm of the light-sensitive material is from 0.2 to 0.7, and wherein the following relations are established with each of the characteristic curves of yellow, magenta, and cyan images, which images are obtained by subjecting the light-sensitive material to exposure and then a color processing:

$$0.7 \leqq \log (E_1/E_2) \leqq 1.3, \text{ and}$$

$$0.7 \leqq \log (E'_1/E'_2) \leqq 1.3, \text{ and}$$

$$-0.2 \leqq \log (E'_1/E'_2) - \log (E_1/E_2) \leqq 0.2$$

in which $E_1$ represents an exposure amount necessary to obtain a color density of Dmin+1.8 in each of the characteristic curves of yellow-, magenta-, and cyan-colored images obtained by a 1-second exposure followed by a color processing;

$E_2$ represents an exposure amount necessary to obtain a color density of Dmin+0.02 in each of the characteristic curves of yellow-, magenta-, and cyan-colored images obtained by a 1-second exposure followed by a color processing;

$E'_1$ represents an exposure amount necessary to obtain a color density of Dmin+1.8 in each of the characteristic curves of yellow-, magenta-, and cyan-colored images obtained by a $10^{-4}$-second exposure followed by a color processing;

$E'_2$ represents an exposure amount necessary to obtain a color density of Dmin+0.02 in each of the characteristic curves of yellow-, magenta-, and cyan-colored images obtained by a $10^{-4}$-second exposure followed by a color processing; and Dmin represents a density obtained by subjecting an unexposed light-sensitive material to a color processing.

12. The method of forming a color image as claimed in claim 11, wherein in the development processing, color developing time is 20 seconds or less.

* * * * *